US008971738B2

(12) United States Patent
Koyama et al.

(10) Patent No.: US 8,971,738 B2
(45) Date of Patent: Mar. 3, 2015

(54) RECORDING MEDIUM IMAGING DEVICE AND IMAGE FORMING APPARATUS

(71) Applicant: Canon Kabushiki Kaisha, Tokyo (JP)

(72) Inventors: Shoichi Koyama, Susono (JP); Tsutomu Ishida, Mishima (JP); Shun-ichi Ebihara, Suntou-gun (JP); Norio Matsui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 13/677,948

(22) Filed: Nov. 15, 2012

(65) Prior Publication Data

US 2013/0135424 A1 May 30, 2013

Related U.S. Application Data

(63) Continuation of application No. 12/793,561, filed on Jun. 3, 2010, now Pat. No. 8,335,443.

(30) Foreign Application Priority Data

Jun. 5, 2009 (JP) ..... 2009-136371

(51) Int. Cl.
*G03G 15/00* (2006.01)
*B41J 29/393* (2006.01)

(52) U.S. Cl.
CPC ..... *B41J 29/393* (2013.01); *G03G 15/5029* (2013.01); *G03G 2215/00447* (2013.01)
USPC ..... 399/45; 382/108

(58) Field of Classification Search
USPC ..... 399/38, 42, 45–49; 358/1.14, 1.6, 3.28; 382/108, 112, 181, 190
See application file for complete search history.

(56) References Cited

U.S. PATENT DOCUMENTS 7,945,096 B2 * 5/2011 Okada ..... 382/181
8,335,443 B2 * 12/2012 Koyama et al. ..... 399/45
RE44,152 E * 4/2013 Maruyama et al. ..... 399/45

FOREIGN PATENT DOCUMENTS

JP 2009-009026 A 1/2009

* cited by examiner

*Primary Examiner* — Hoan Tran
(74) *Attorney, Agent, or Firm* — Canon U.S.A., Inc. IP Division

(57) ABSTRACT

There is provided a recording medium imaging device capable of properly selecting pixels used for determining the kind of the recording medium from the captured surface image to remove pixels from which the surface property of the recording medium cannot be properly determined because the pixels extremely high in light quantity are affected by some sort of dirt or scratches in determining the kind of a recording medium. This allows the determination of kind of the recording medium based on the normally captured surface image to reduce the decrease in accuracy in determining the kind of the recording medium.

26 Claims, 18 Drawing Sheets

RECORDING MEDIUM IMAGING DEVICE AND IMAGE FORMING APPARATUS

This application is a continuation of application Ser. No. 12/793,561, filed on Jun. 3, 2010, which claims the benefit of Japanese Patent Application No. 2009-136371 filed Jun. 5, 2009, which are hereby incorporated by reference herein in their entirety.

BACKGROUND OF THE INVENTION

1. Field of the Invention

The present invention relates to a recording medium imaging device and an image forming apparatus capable of determining the kind of a recording medium.

2. Description of the Related Art

In a conventional image forming apparatus, the kind of a recording medium (i.e., size, thickness, and the like) has been set by a user through a computer as an external apparatus, for example, or through an operation panel provided on the main body of the image forming apparatus. Transfer conditions (such as a transfer voltage and the conveyance speed of a recoding medium in transfer) and fixing conditions (such as a fixing temperature and the conveyance speed of a recoding medium in fixing) in a transfer unit, for example, are controlled according to the setting.

In order to reduce the burden of the user in setting the kind of a recording medium through such a computer or an operation panel, there has been provided an image forming apparatus including a sensor for automatically determining the kind of a recording medium. The image forming apparatus including the sensor automatically determines the kind of a recording medium and then sets the transfer conditions and the fixing conditions according to the determination results.

More specifically, as discussed in Japanese Patent Application Laid-Open Nos. 2002-182518 and 2004-038879, some image forming apparatus determine the kind of a recording medium in such a manner that a CMOS sensor captures the surface image of the recording medium and detects the surface smoothness thereof from the captured image. The CMOS sensor directly captures a shadow cast by the unevenness of the surface, which enables the accurate determination of the recording medium. In distinguishing among glossy paper, plain paper, and rough paper, for example, the image forming apparatus can accurately determine the kind of a recording medium by detecting the presence of unevenness, or size and depth thereof.

In such prior art, however, paper dust can be generated on the recording medium in conveying the recording medium in the image forming apparatus. Dust can adhere to the recording medium or the recording medium can be scratched. If there are dirt or scratches due to such paper dust on the recording medium, a surface image with a characteristic different from an actual recording medium can be captured under the influence of the foreign matters. If the recording medium is determined based on the surface image containing such foreign matters, a determination accuracy for the recording medium decreases.

SUMMARY OF THE INVENTION

The present invention according to the present application is directed to a recording medium imaging device which captures an image of the recording medium surface to determine the recording medium and, in particular, to a recording medium imaging device which accurately determines the kind of a recording medium even if the surface image of the recording medium containing dirt or scratches is captured.

According to an aspect of the present invention, a recording medium imaging device includes: an irradiation unit configured to emit light to a recording medium which is being conveyed; an imaging unit configured to capture as a surface image having a plurality of pixels, light reflected by the recording medium to which the light is emitted by the irradiation unit and which is being conveyed; and a control unit configured to determine the kind of the recording medium using the surface image captured by the imaging unit; wherein the control unit determines the kind of the recording medium using an image obtained by removing pixels which do not have a predetermined brightness from a plurality of pixels of the surface image Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

It is to be understood that the following exemplary embodiments do not limit the invention of the claims. All the combinations of features described in the exemplary embodiments are not always essential as means for solving problems in the invention.

Figure 1:
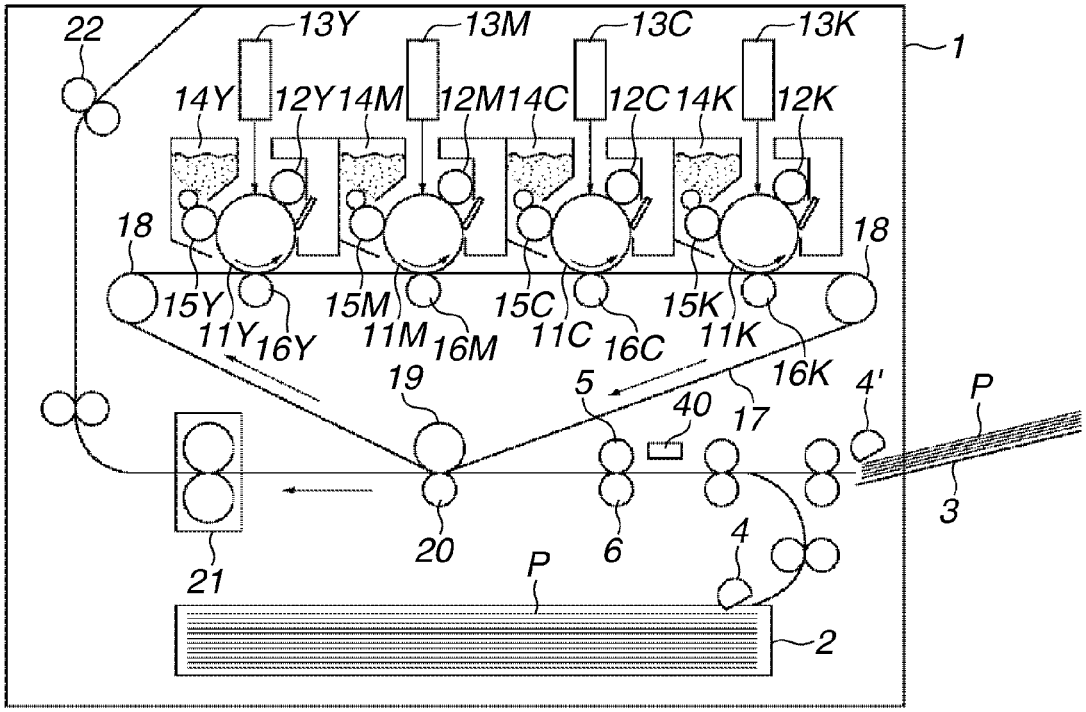
FIG. 1 is a schematic diagram illustrating a configuration of an image forming apparatus.

The recording medium imaging device according to a first exemplary embodiment can be used, for example, in a copying machine or an image forming apparatus. FIG. 1 is a schematic diagram illustrating, as an example, a color image forming apparatus which includes the recording medium imaging device using an intermediate transfer belt, and a plurality of image forming units is arranged in parallel.

The configuration of the color image forming apparatus 1 in FIG. 1 is described below. A sheet supply cassette 2 contains a recording medium P. A paper feed tray 3 contains the recording medium P. A sheet feeding roller 4 feeds the recording medium P from the sheet supply cassette 2 or the paper feed tray 3. A sheet feeding roller 4' feeds the recording medium P from the sheet supply cassette 2 or the paper feed tray 3. A conveyance roller 5 conveys the fed recording medium P. A conveyance opposing roller 6 opposes the conveyance roller 5.

Photosensitive drums 11Y, 11M, 11C, and 11K carry yellow, magenta, cyan, and black developers respectively. Charging rollers 12Y, 12M, 12C, and 12K serving as a primary charging unit for each color uniformly charge the photosensitive drums 11Y, 11M, 11C, and 11K to a predetermined electric potential. Optical units 13Y, 13M, 13C, and 13K emit a laser beam corresponding to the image data of each color to the photosensitive drums 11Y, 11M, 11C, and 11K charged by the primary charging unit to form an electrostatic latent image.

Development units 14Y, 14M, 14C, and 14K visualize the electrostatic latent images formed on the photosensitive drums 11Y, 11M, 11C, and 11K. Developer conveyance rollers 15Y, 15M, 15C, and 15K convey the developers in the development units 14Y, 14M, 14C, and 14K to the photosensitive drums 11Y, 11M, 11C, and 11K. Primary transfer rollers 16Y, 16M, 16C, and 16K for each color primarily transfer the images formed on the photosensitive drums 11Y, 11M, 11C, and 11K. An intermediate transfer belt 17 bears the primarily transferred image.

A drive roller 18 drives the intermediate transfer belt 17. A secondary transfer roller 19 transfers the image formed on the intermediate transfer belt 17 to the recording medium P. A secondary transfer counter roller 20 opposes the secondary transfer roller 19. A fixing unit 21 melts and fixes the developer image transferred onto the recording medium P while the recording medium P is being conveyed. A sheet discharge roller 22 discharges the recording medium P on which the developer image is fixed by the fixing unit 21.

The photosensitive drums 11Y, 11M, 11C, and 11K, the charging rollers 12Y, 12M, 12C, and 12K, the development units 14Y, 14M, 14C, and 14K, and the developer conveyance rollers 15Y, 15M, 15C, and 15K are integrated respectively for each color. Thus, the integrated unit of the photosensitive drum, the charging roller, and the development unit is referred to as a cartridge. The cartridge for each color can be easily detached from the color image forming apparatus 1.

The image forming operation of the color image forming apparatus 1 is described below. Print data including printing instructions and image information is input to the color image forming apparatus 1 from a host computer (not shown). Then, the color image forming apparatus 1 starts a printing operation and the recording medium P is fed from the sheet supply cassette 2 or the paper feed tray 3 by the sheet feeding roller 4 or the sheet feeding roller 4' and conveyed to a conveyance path. The recording medium P temporarily stops at the conveyance roller 5 and the conveyance opposing roller 6 to synchronize an operation of forming an image on the intermediate transfer belt 17 with timing of its conveyance, and waits until the image is formed.

In forming an image, the photosensitive drums 11Y, 11M, 11C, and 11K are charged to a certain potential by the charging rollers 12Y, 12M, 12C, and 12K, along with the operation of feeding the recording medium P. The optical units 13Y, 13M, 13C, and 13K expose and scan a surface of the charged photosensitive drums 11Y, 11M, 11C, and 11K according to the input print data with a laser beam to form an electrostatic latent image. The development units 14Y, 14M, 14C, and 14K and the developer conveyance rollers 15Y, 15M, 15C, and 15K perform development to visualize the formed electrostatic latent images.

The electrostatic latent images formed on the surface of the photosensitive drums 11Y, 11M, 11C, and 11K are developed to be visual images in respective colors by the development units 14Y, 14M, 14C, and 14K. The photosensitive drums 11Y, 11M, 11C, and 11K are in contact with the intermediate transfer belt 17 and rotate in synchronization with the rotation of the intermediate transfer belt 17. The developed image are sequentially transferred and superimposed on the intermediate transfer belt 17 by the primary transfer rollers 16Y, 16M, 16C, and 16K. The images transferred onto the intermediate transfer belt 17 are secondarily transferred onto the recording medium P by the secondary transfer roller 19 and the secondary transfer counter roller 20.

Thereafter, the recording medium P is conveyed to a secondary transfer unit to secondarily transfer the image onto the recording medium P in synchronization with the image forming operation. The developer image formed on the intermediate transfer belt 17 is transferred onto the conveyed recording medium P by the secondary transfer roller 19 and the secondary transfer counter roller 20. The developer image transferred onto the conveyed recording medium P is fixed by the fixing unit 21 including a fixing roller. The recording medium P on which the transferred developer image is fixed, is discharged to a discharge tray (not shown) by the sheet discharge roller 22 and the image forming operation is ended.

In the image forming apparatus in FIG. 1, a recording medium imaging device 40 according to the present invention is arranged on the upstream side of the conveyance roller 5 and the conveyance opposing roller 6, and is capable of detecting information reflecting the surface smoothness of the recording medium P conveyed from the sheet supply cassette 2 or the like. In the present exemplary embodiment, the recording medium imaging device 40 determines a type of the recording medium P while the recording medium P fed into the image forming apparatus from the sheet supply cassette 2 is being conveyed before the recording medium P is sandwiched between the conveyance roller 5 and the conveyance opposing roller 6.

A conventional imaging apparatus images a predetermined region by an area sensor when the recording medium P is stopped. The recording medium imaging device 40 according to the present invention can image a wider region of the recording medium P being conveyed by a line sensor, and can capture the region of a surface image necessary for determination of the recording medium P by changing its range if needed.

Figure 2:
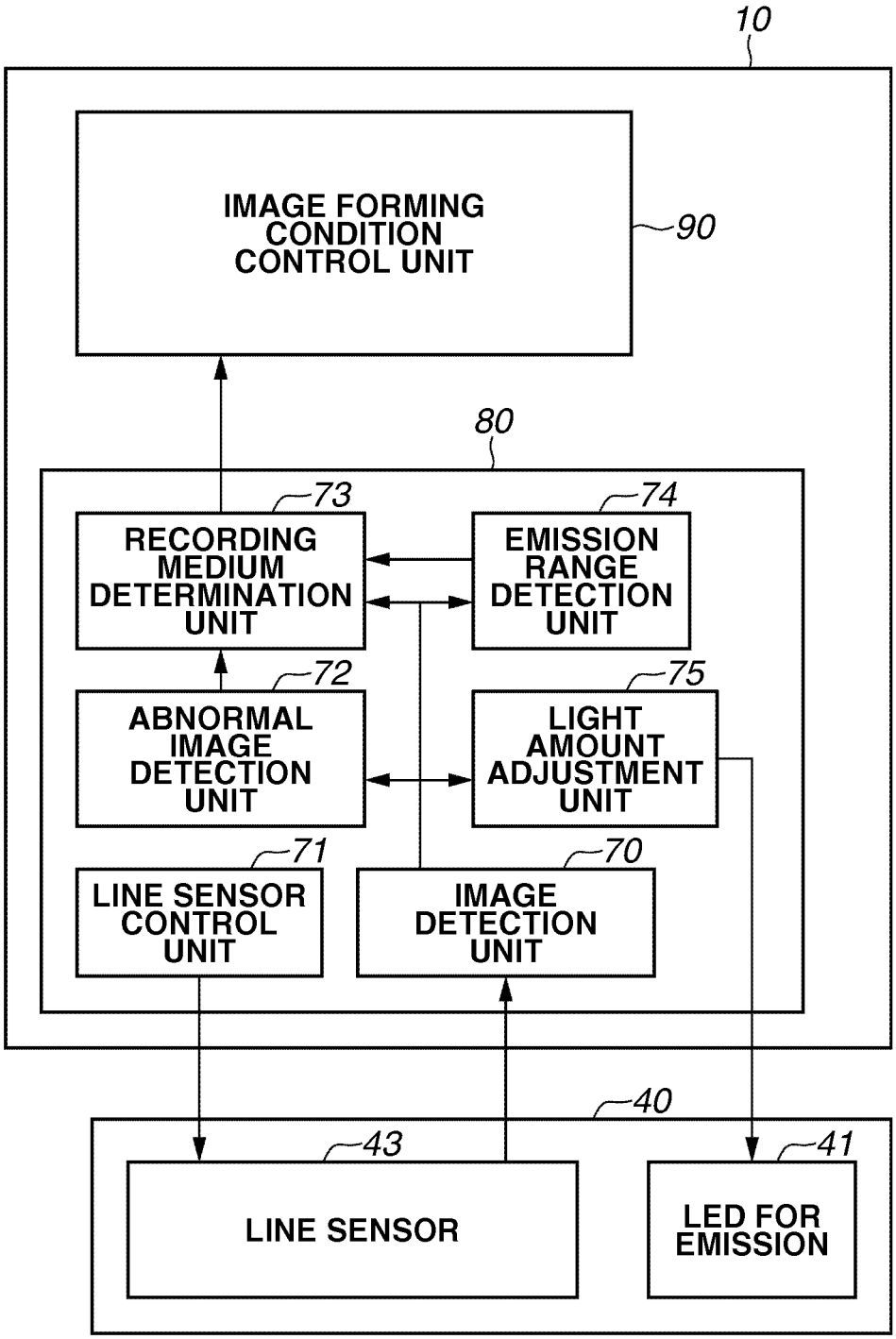
FIG. 2 is an operation control block diagram of a recording medium imaging device.

FIG. 2 is an example of a block diagram illustrating an operation control of the recording medium imaging device 40. A control unit 10 controls various image forming conditions using an image forming condition control unit 90 for controlling the image forming conditions based on information acquired from various types of sensors. A determination unit 80 in the control unit 10 includes an image detection unit 70, a line sensor control unit 71, an abnormal image detection unit 72, a recording medium determination unit 73, an emission range detection unit 74, and a light amount adjustment unit 75.

The line sensor control unit 71 controls the operation of a line sensor 43 through an I/O port. The image detection unit 70 obtains a surface image captured by the line sensor 43 to detect image information. The light amount adjustment unit 75 performs a calculation control related to a light amount adjustment based on the image information obtained by the image detection unit 70 to adjust the emission and the light amount of an LED for emission 42. The emission range detection unit 74 detects the irradiation range of the LED for emission 42.

The abnormal image detection unit 72 detects an abnormal image from the surface image of the recording medium P. The recording medium determination unit 73 determines the kind of the recording medium P using the surface image from which an abnormal image is removed by the abnormal image detection unit 72 and notifies the image forming condition control unit 90 of the result of the determined recording medium P. The LED for emission 42 used here may use a xenon tube or a halogen lamp, for example.

Figure 3A:
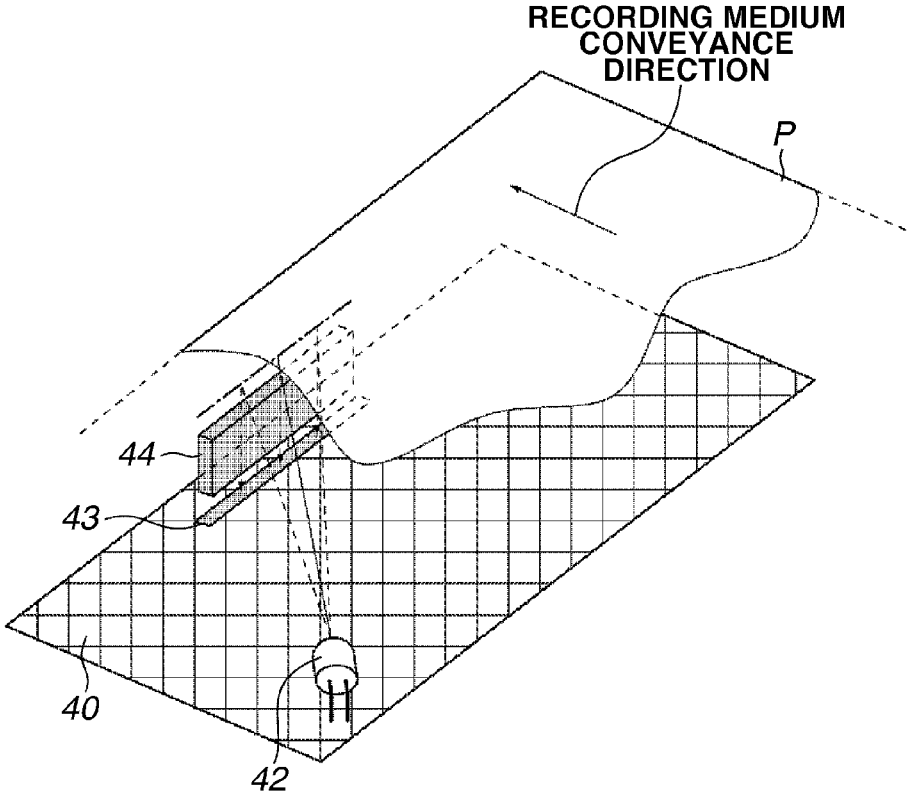
FIGS. 3A, 3B, and 3C are a schematic perspective view illustrating a configuration of the recording medium imaging device.
Figure 3B:
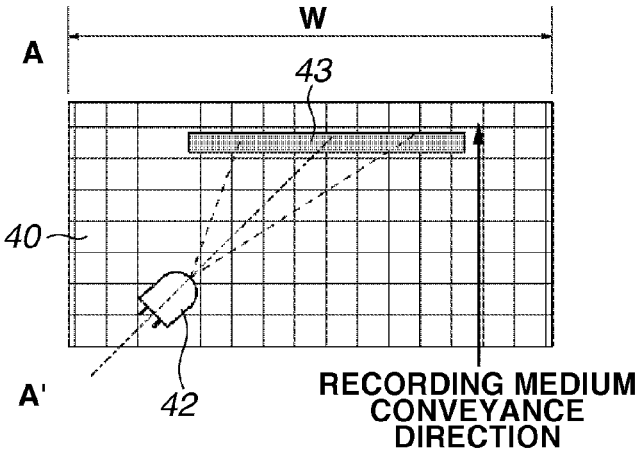
Figure 3C:
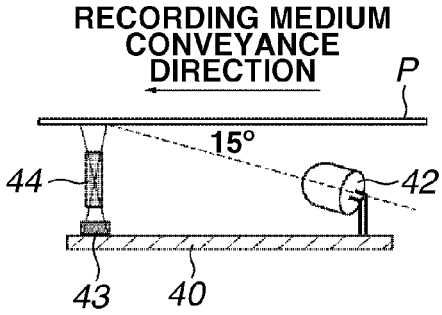

The recording medium imaging device 40 is described below. FIG. 3 is a schematic diagram illustrating a general configuration for acquiring a surface image reflecting a surface smoothness. FIGS. 3A, 3B, and 3C are a perspective view, a top view, and a cross section of the configuration taken along the line A-A' of FIG. 3B respectively. The recording medium imaging device 40 includes the LED for emission 42, which is a light irradiation unit, the line sensor 43 with a plurality of pixels, which is an imaging unit, and an image forming lens 44, which is an image forming unit. Although, in the present embodiment, a white light LED with a high directivity is used as the LED for emission 42, the LED for emission 42 is not limited to the white light LED as long as the recording medium P can be irradiated. Furthermore, while a rod lens array is used as the image forming lens 44, the image forming lens 44 is not limited to the rod lens array as long as a lens which can receive light reflected from the surface of the recording medium P and form an image, is used.

The LED for emission 42 emits light to the surface of the recording medium P at an angle of 15°. When the light is obliquely emitted to the surface of the recording medium P at a shallow angle, a shadow produced by unevenness on the surface of the recording medium P can be emphasized. Reflected light including shadow information reflecting the surface smoothness of the recording medium P is concentrated through the image forming lens 44 and imaged on the line sensor 43. In the present exemplary embodiment, as an example, an effective pixel size of the line sensor 43 has a range of approximately 0.042 mm wide by approximately 19.0 mm long and the surface image on the recording medium P is captured at a resolution of 600 dpi.

The LED for emission 42 is arranged such that the irradiation angle is 45° with respect to the conveyance direction of the recording medium P. In other words, if the fiber orientation of the recording medium P is parallel to the direction in which the recording medium P is conveyed, light is obliquely emitted at an angle of 45° with respect to the fiber orientation, so that longitudinal and transverse orientations can be reduced. This allows the acquisition of a surface image which is high in contrast and reflects an unevenness level of a stable surface, which improves accuracy in the determination of the recording medium P.

Figure 4A:
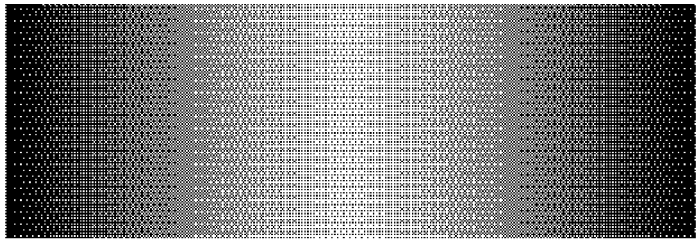
FIGS. 4A and 4B are a surface image captured by the recording medium imaging device and a brightness distribution respectively.
Figure 4B:
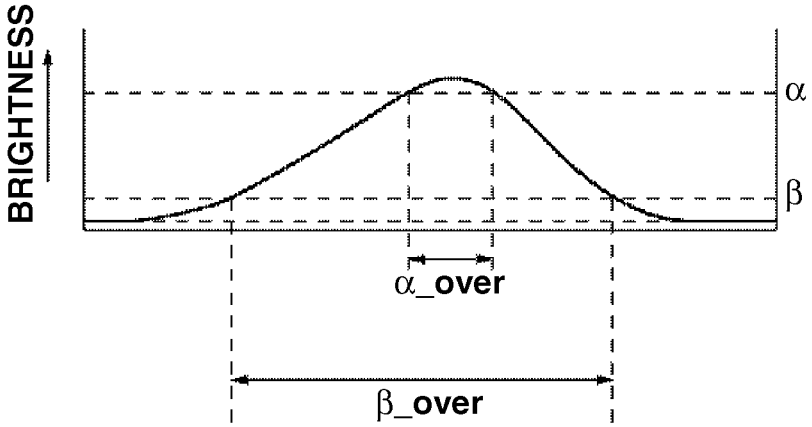

A method of selecting an effective image range from the brightness distribution of the light to be emitted is described below. FIG. 4A illustrates a surface image in the total image range of the line sensor captured with the reference light quantity about which the light quantity correction of the LED for emission 42 is finished. FIG. 4B is a graph indicating brightness distribution, from which the surface image can be obtained. A white part in FIG. 4A is high (bright) in brightness and a black part is low (dark) in brightness.

It is therefore estimated that an optical axis exists in the white part. In FIG. 4B, it is determined that the optical axis exists in the range of a brightness distribution of "α_over" which exceeds a brightness intensity α that is a light quantity correction reference. The range of "α_over" is set with a certain flexibility, because at the time of measurement for calculating the optical axis, a part with a high light quantity may be generated on the surface image due to foreign matters or scratches in a partially narrow area, which should not be determined by mistake to be the optical axis.

The light quantity of the LED for emission 42 is corrected using the surface image captured in "α_over." In the present exemplary embodiment, a light quantity correction value in a reference plate is α=192 (if brightness intensity has 256 gradations (0 (dark) to 255 (bright)) considering the shortest time for the line sensor 43 capturing images, conveyance speed and irregular reflection rate. An example of a control method as to the light quantity correction is described in FIG. 5.

In FIG. 4A, α is a threshold for detecting an optical axis, "α_over" is greater in brightness than the threshold α, and the optical axis existing in the range can be detected. In FIG. 4B, β is a threshold indicating brightness selected as an effective image range and "β_over" is greater in brightness than the threshold β, so that the range over the brightness is indicated as the effective image range. The threshold β is a value at which the surface image having little possibility of an erroneous determination which is caused due to decreased accuracy in determination of the recording medium P, can be captured.

In the present exemplary embodiment, while approximately a quarter of the maximum value of the light quantity is set to the threshold β as an example, this can be arbitrarily set according to a determination accuracy required for the recording medium P. It is determined that the range of "β_over" exceeding the threshold β is the effective image range.

Figure 5:
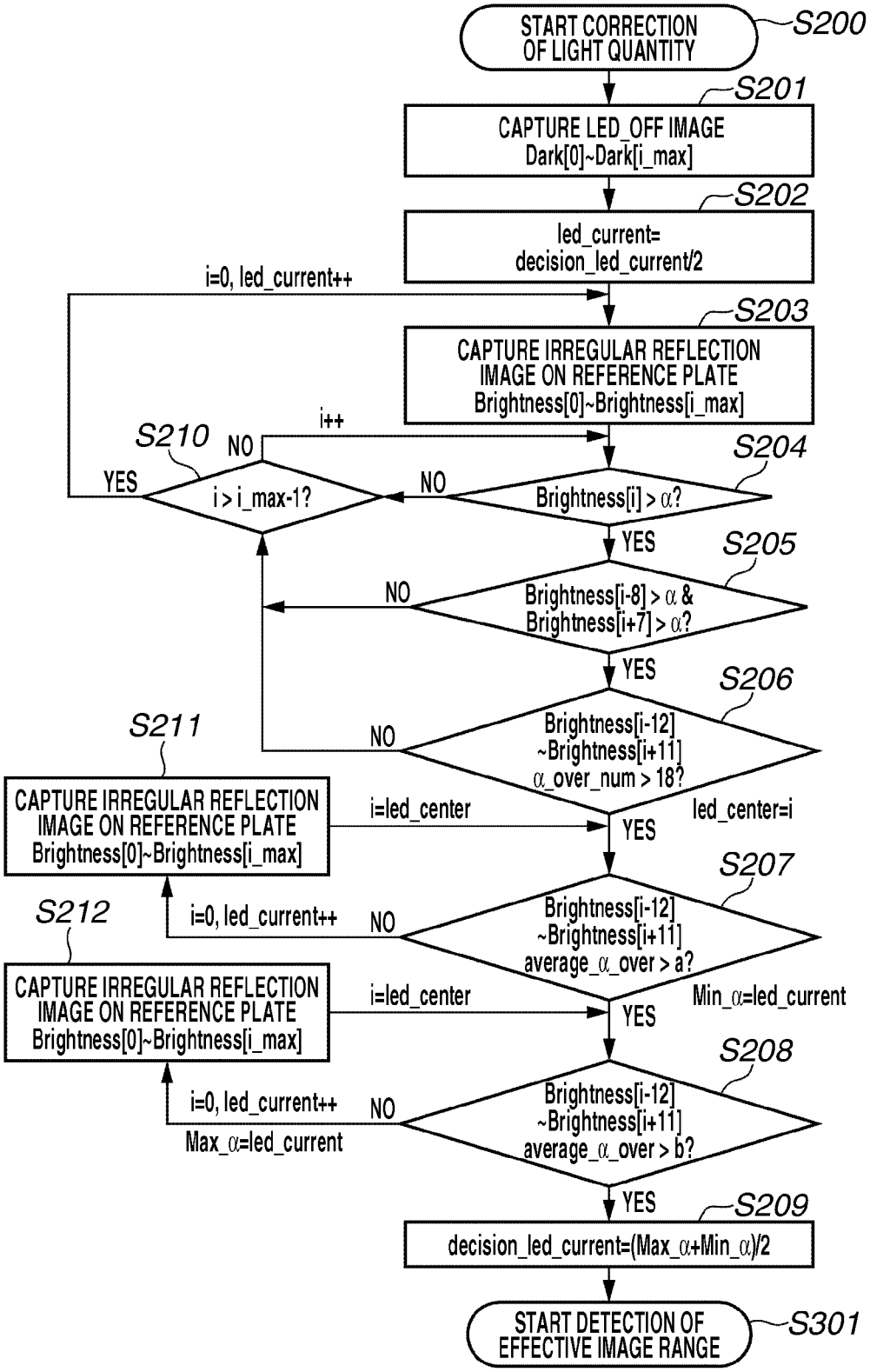
FIG. 5 is a flow chart describing a method of correcting light quantity.

A method of correcting light quantity is described in a flow chart in FIG. 5. In step 201, an image is captured using the line sensor 43 while the LED for emission 42 is turned off, and the captured image is stored in arrays for a black reference "Dark [0]" to "Dark [i_max]", which is a buffer for the captured image. The black reference "Dark [0]" to "Dark [i_max]" is used as a black reference (dark portion) of data for shading correction described later. In the present exemplary embodiment, "i_max" in the array for the black reference is the maximum effective pixel of the line sensor 43 (the line sensor 43 in the present exemplary embodiment uses a 468-pixel sensor at a resolution of 600 dpi, so that "i_max"=468−1.).

In step 202, the current of the LED for emission 42 half a light quantity correction current value which is a basic light emission current value (hereinafter referred to as "decision_led_current") is applied to cause the LED to emit light. In a second and subsequent light quantity correction controls, if the light quantity correction current value is fixed, the number of loop control times can be somewhat reduced in steps 203, 204, and 210. For this reason, if the light quantity correction is started in an initial condition, "decision_led_current" uses 0 or a predetermined default.

While the LED for emission 42 emits light with the current value in step 202, an irregular reflection image on the reference plate is captured by the line sensor 43 in step 203 and stored in arrays for light quantity correction "Brightness [0]" to "Brightness [i_max]", which is a buffer for the captured image. "i_max" in the array for the light quantity correction is the maximum effective pixel of the line sensor 43. In step 204, the data stored in the array for the light quantity correction is sequentially compared with the threshold α of light quantity, which is a light quantity correction reference.

If the data does not exceed the threshold α (NO in step 204), in step 210, it is determined whether the number of the compared data of the array for the light quantity correction reaches "i_max." If the number of array data does not reach "i_max" (NO in step 210) for the processing in step 204, the data stored in a next array for the light quantity correction is continuously compared with the threshold α with i=i+1 in step 210. If the number of array data reaches i_max (YES in step 210), the current setting value of the LED for emission 42 is increased by one stage to cause the LED for emission 42 to emit light. At this point, the number of the array data for the light quantity correction is initialized (i=0) to obtain an image. Again in step 203, an irregular reflection image on the reference plate is captured by the line sensor 43 and stored in the arrays for light quantity correction "Brightness [0]" to "Brightness [i_max]."

While the processing is being repeated between steps 204 and 203, if array data exceeding the threshold α which is the light quantity correction reference is detected (YES in step 204), it is determined whether pixels in the vicinity previous and subsequent to the detected array data exceed the threshold α in step 205. In the present exemplary embodiment, the array data which exist in the eighth pixel before and the seventh pixel after the array detected in step 204 are compared with the threshold α as an example.

If neither of the array data exceeds the threshold α (NO in step 205), the proceeding returns again to step 210. If both the array data exceed the threshold α (YES in step 205), the array data is probably in the vicinity of the optical axis of the LED for emission 42. In step 206, the array range compared with the threshold α is extended. Furthermore, the detection process of the optical axis is performed.

In step 206, the array data which range from the 12th pixel before to the 11th pixel after the array detected in step 204 are compared with the threshold α and the number of the array data exceeding the threshold α is counted. If as a result of counting within the range, the number of pixels greater than 75% (i.e., in the present exemplary embodiment, 18 pixels or more out of 24 pixels) does not reach the number of array data exceeding the threshold α (NO in step 206), the proceeding returns to step 210. If as the result of counting within the range, the number of pixels greater than 75% reaches the number of array data exceeding the threshold α (YES in step 206), it is determined that the optical axis range is detected.

In step 207, an average process is performed using the array data exceeding the threshold α among the array data which range from the 12th pixel before to the 11th pixel after the array detected in step 204. At this point, the value of the present detection array number is stored in a variable "led_center" used for detecting the optical axis range as the result of detecting the optical axis range. The present exemplary embodiment uses the following calculation method as an example of the average process method.

If the array exceeding the threshold α is detected and the following result is obtained:

$$\alpha_over=\{Brightness[i-12], Brightness[i-11], Brightness[i-9], \ldots Brightness[i], Brightness[i+1], Brightness[i+3], \ldots Brightness[i+9], Brightness[i+11]\} \quad (1)$$

$$\alpha_over_num=20 \text{ (if the number of the above arrays is 20)} \quad (2),$$

the array is extracted as "α_over" indicated by the above equation (1) and the number of the extracted array is counted according to the above equation (2). Therefore, the average of data within the array in step 207 is calculated by the following equation (3) based on the equations (1) and (2):

$$average_\alpha_over=\alpha_over/\alpha_over_num \quad (3).$$

The average "average_α_over" calculated by the equation (3) is compared with the lower limit value "a" of range of the light quantity correction. If the average "average_α_over" is not greater than the lower limit value "a" of range of the light quantity correction (NO in step 207), the processing proceeds to step 211. In step 211, similarly to the case where the number of the array data reaches i_max in step 210, the setting value of the current for the LED for emission 42 is increased by one step to cause the LED for emission 42 to emit light.

At this point, the number of the array data for the light quantity correction of the LED for emission 42 is initialized (i=0) and an irregular reflection image on the reference plate is captured by the line sensor 43 and stored in the arrays "Brightness [0]" to "Brightness [i_max]" for light quantity correction of the LED for emission 42. After the data is stored in the array, the array number "i" stored as the optical axis is returned to "led_center" (i.e., i=led_center).

Thus, the light quantity detection procedure by the LED for emission 42 in step 207 can be carried out every time on the same optical axis and in the same range on which attention is focused. Although not illustrated in FIG. 5, if the setting value of the current for the LED for emission 42 is maximized while step 210 is being repeated, a step for escaping from the light quantity correction may be inserted as an error.

While the processing is being repeated between steps 207 and 211, if the average "average_α_over" becomes greater than the lower limit value "a" of range of the light quantity correction for the LED for emission 42 (YES in step 207), the processing proceeds to step 208. At this point, the present current-setting value of the LED for emission 42 is updated and stored in a variable "Min_α" for detection of the light quantity correction range lower-limit value. In step 208, the average "average_α_over" calculated by the average calculation of the array data in the similar manner to step 207 is compared with the upper limit value "b" of range of the light quantity correction for the LED for emission 42.

If the average "average_α_over" does not become greater than the upper limit value "b" of range of the light quantity correction for the LED for emission 42, the present current-setting value of the LED for emission 42 is updated and stored in the value of the variable "Max_α" for detection of the light quantity correction range upper-limit value.

In step 212, as is the case with step 211, the current-setting value of the LED for emission 42 is increased by one stage to cause the LED for emission 42 to emit light. At this point, the number of the array data for the light quantity correction of the LED for emission 42 is initialized (i=0) and an irregular reflection image on the reference plate is captured by the line sensor 43 and stored in the arrays "Brightness [0] to Brightness [i_max]" for light quantity correction. In step 212, as is the case with step 211, after the data is stored in the array, the array number "i" stored as the optical axis is returned to "led_center" (i.e., i=led_center).

Thus, the light quantity detection procedure by the LED for emission 42 in step 207 can be carried out every time on the same optical axis and in the same range on which attention is focused. While the processing is being repeated between steps 208 and 212, if the average "average_α_over" becomes greater than the upper limit value "b" of range of the light quantity correction for the LED for emission 42 (YES in step 208), the processing proceeds to step 209. In step 209, a light quantity correction value is determined using the value stored when the processing proceeds to steps 211 and 212. More specifically, the apparatus uses the variable "Min_α" for detection of light quantity correction range lower-limit value for the LED for emission 42, and the variable "Max_α" for detection of light quantity correction range upper-limit value for the LED for emission 42.

A light quantity correction value "decision_led_current" for the LED for emission 42 is calculated by the following equation:

$$\text{"decision_led_current"}=(\text{Max}_\alpha+\text{Min}_\alpha)/2 \quad (4)$$

As represented by the equation (4), the mean value of the variable "Min_α" for detection of the light quantity correction range lower-limit value for the LED for emission 42 and the variable "Max_α" for detection of the light quantity correction range upper-limit value for the LED for emission 42 is used as the light quantity correction value for the LED for emission 42 to stabilize the quantity of light emitted by the LED for emission 42. Since the quantity of light emitted by the LED for emission 42 is stabilized, the surface image with high accuracy can be captured, so that accuracy is stabilized in determining the recording medium P.

Figure 6:
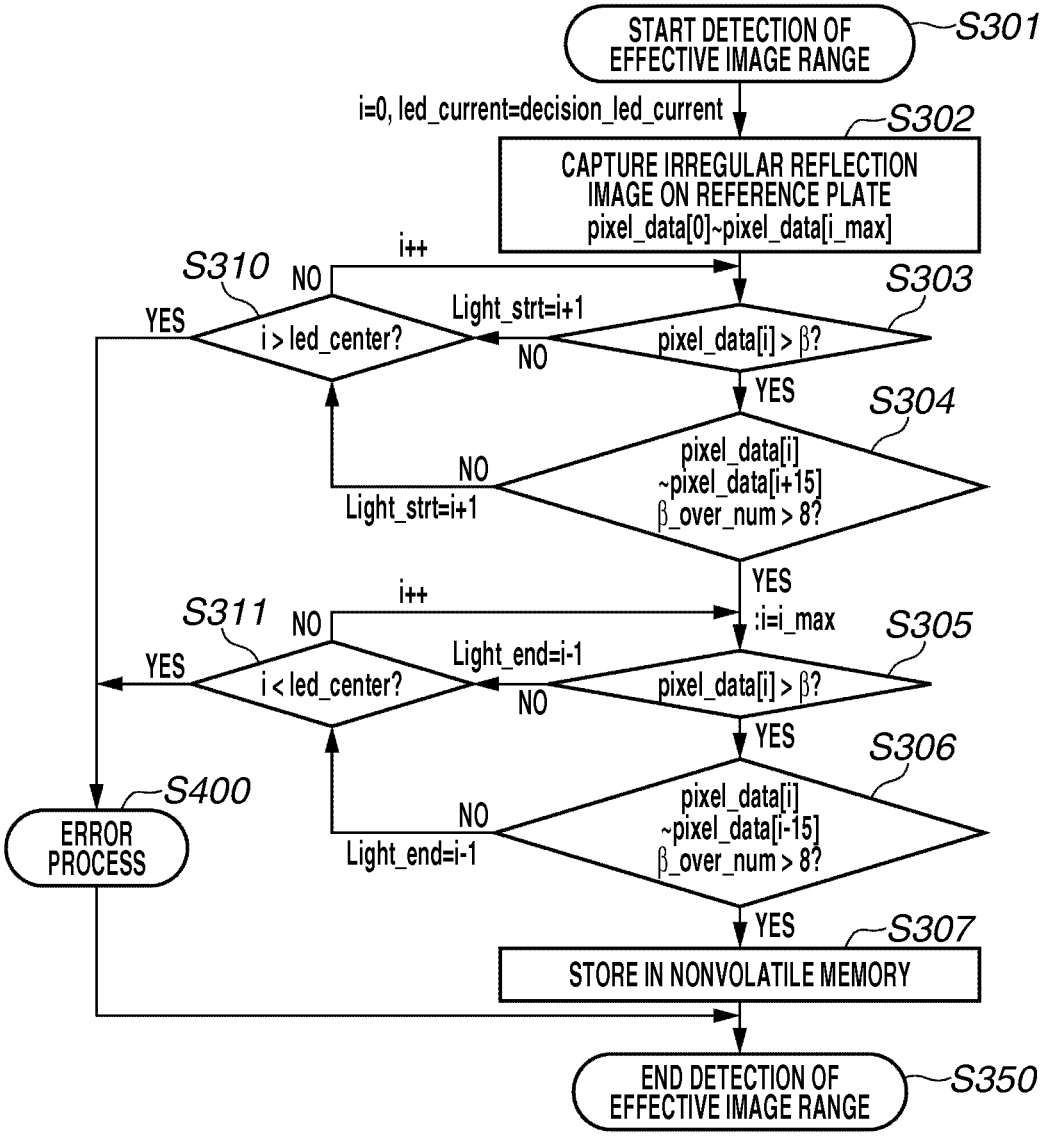
FIG. 6 is a flow chart describing a method of selecting an effective image range.

A method of selecting an effective image range is described below with reference to a flow chart in FIG. 6. The number of the array data for measuring an effective image range of the LED for emission 42 is initialized (i=0). An irregular reflection image on the reference plate is captured by the line sensor 43 and preparations are made for storing the image into arrays "Pixel_data[0]" to "Pixel_data[i_max]", which is a buffer. The LED for emission 42 is set to the light quantity correction value "decision_led_current" determined in FIG. 5 to emit light. Thereafter, when light quantity becomes stable, in step 302, an irregular reflection image on the reference plate is captured by the line sensor 43. The captured data is stored in the arrays "Pixel_data[0]" to "Pixel_data[i_max]" for the LED for emission 42.

In step 303, the information of the array "Pixel_data[1]" is compared with the threshold β, which is an effective image range detection reference. An array variable is sequentially increased from an array variable i=0 to confirm data in the array. This is done to detect one of the limits in the effective image range. The data stored in the array for the effective image range of the LED for emission 42 is sequentially compared with the threshold β, which is the effective image range detection reference.

In step 310, if the information of the array "Pixel_data[1]" does not exceed the threshold β (NO in step 303), in step 310, it is determined whether the number of the array data for detecting the effective image range reaches the variable "led_center." If the number of the array data does not reach the variable "led_center" (NO in step 310), the data stored in the following array for detecting the effective image range is compared and i=i+1. If the number of the array data reaches the variable "led_center" (YES in step 310), it is determined that an error occurs in which the effective image range cannot be measured because an irregular reflection image on the reference plate cannot be captured for some reason.

In step 400, an error process is performed. The measurement of the effective image range is ended. If the array data exceeding the threshold β is confirmed before the number of the array data reaches the variable "led_center" (YES in step 303), in step 304, 16 continuous arrays including the number of the array data detected in step 303 are compared with the threshold β. The number of the array data exceeding the threshold β is stored in "β_over_num."

If the number of pixels in which "β_over_num" is greater than 50% does not reach the number of the array data exceeding the threshold β (NO in step 304), the present detection array number+1 is stored in an effective image range detection variable "Light_strt" as the detection result in the vicinity of the effective image range. The present detection array number+1 is stored because the present detection array number+1 may be one end of emission range at the time of detecting the following array. After the present detection array number+1 is stored, the processing returns to step 310. While, in the present exemplary embodiment, "β_over_num" is set to 50% (i.e., it exceeds 8 pixels out of 16 pixels), "β_over_num" may be arbitrarily set.

The array exceeding the threshold β is detected by the following equations as an example:

$$\beta_\text{over}=\{\text{Pixel_data}[i], \text{Pixel_data}[i+1], \text{Pixel_data}[i+3], \ldots \text{Pixel_data}[i+12], \text{Pixel_data}[i+13], \text{Pixel_data}[i+14]\} \quad (5)$$

$$\beta_\text{over_num}=12 \text{ (if the number of the above arrays is 12)} \quad (6).$$

If the number of pixels in which "β_over_num" is greater than 50% reaches the number of the array data exceeding the threshold β, it is determined that one end of the effective image range is detected, and the proceeding proceeds to step 305.

When the proceeding proceeds to step 305, the array is sequentially decreased and confirmed while the number of the array data is taken as i=i_max, to detect another end of the effective image range. The operations in steps 305, 306, and 311 are similar to those in the previous steps 303, 304, and 310 respectively, so that the description thereof is omitted. In step 307, information about the optical axis range, the light quantity correction value, and the effective image range of the recording medium imaging device 40 is stored in a rewritable non-volatile memory.

It is premised that the LED for emission 42 used in the present exemplary embodiment described above is a light source that emits light in a circular pattern while diffusing. If a light source which is in a surface emitting shape like a fluorescent tube and has a uniform and wide brightness distribution in the width direction, the light quantity correction can be made using the average of all pixels without detecting the optical axis of the LED for emission 42. While, in the present exemplary embodiment, the threshold and the range are described and set in each determination process, the present exemplary embodiment is not limited to the numeric values of the examples used for description. Further, the selection of the effective image range and the correction of the light quantity are performed at a time of shipment from the factory or after the shipment using the reference plate. For the image forming apparatus including no reference plate, the selection of the effective image range and the correction of the light quantity may be performed at the shipment from the factory or after the shipment using a reference paper.

Figure 7A:
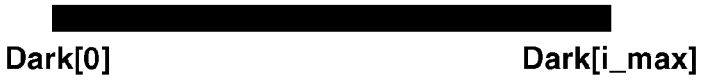
FIGS. 7A, 7B, 7C, 7D, and 7E are charts for obtaining an effective image range from brightness distribution.
Figure 7B:
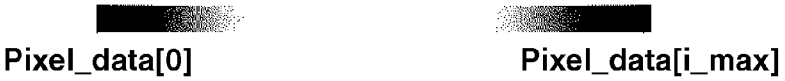
Figure 7C:
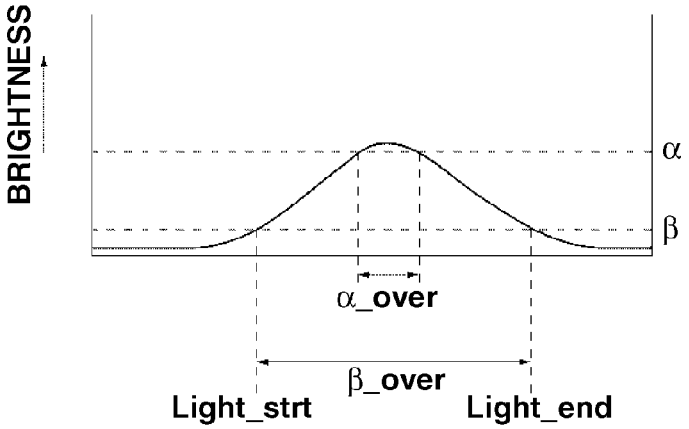

A method of selecting an effective image range is described below with reference to FIG. 7. FIG. 7A is an image captured in step 201 without emitting light by the LED for emission 42. The image is stored in the arrays "Dark [0]" (left side of the figure) to "Dark [i_max]" (right side of the figure). FIG. 7B is an image captured in step 302 when the LED for emission 42 emits light in a corrected light quantity. The image is stored in the arrays "Pixel_data [0]" (left side of the figure) to "Pixel_data [i_max]" (right side of the figure). In steps 301 to 350, the effective image range is selected from data stored in the array in FIG. 7B. A range of "Light_strt" to "Light_end" in FIG. 7C is the effective image range.

Figure 7D:
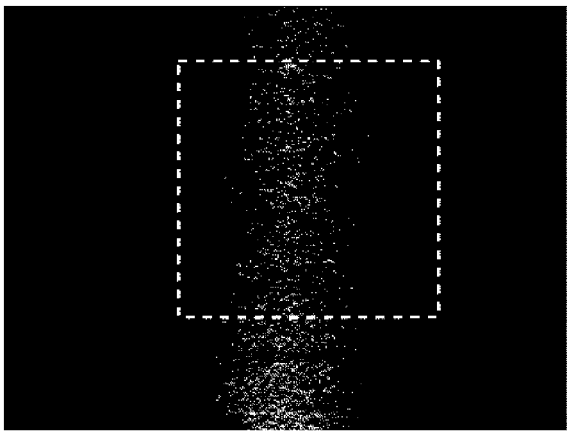
Figure 7E:
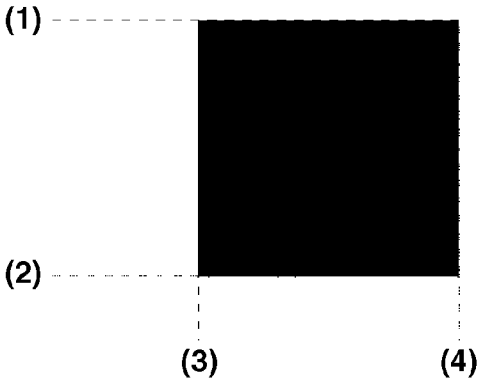

The surface image in the range encircled by (1) to (4) in FIG. 7D is the effective image range where the recording medium P is determined. FIG. 7E is a shading image of the recording medium P, in which the surface image in a frame indicated by a dotted line in FIG. 7D is subjected to a general shading correction using FIGS. 7A and 7B. In the present exemplary embodiment, while the size of the surface image is 230×230 pixels (52900 pixels), the size of the surface image is not limited to this size but may be arbitrarily set.

Figure 8:
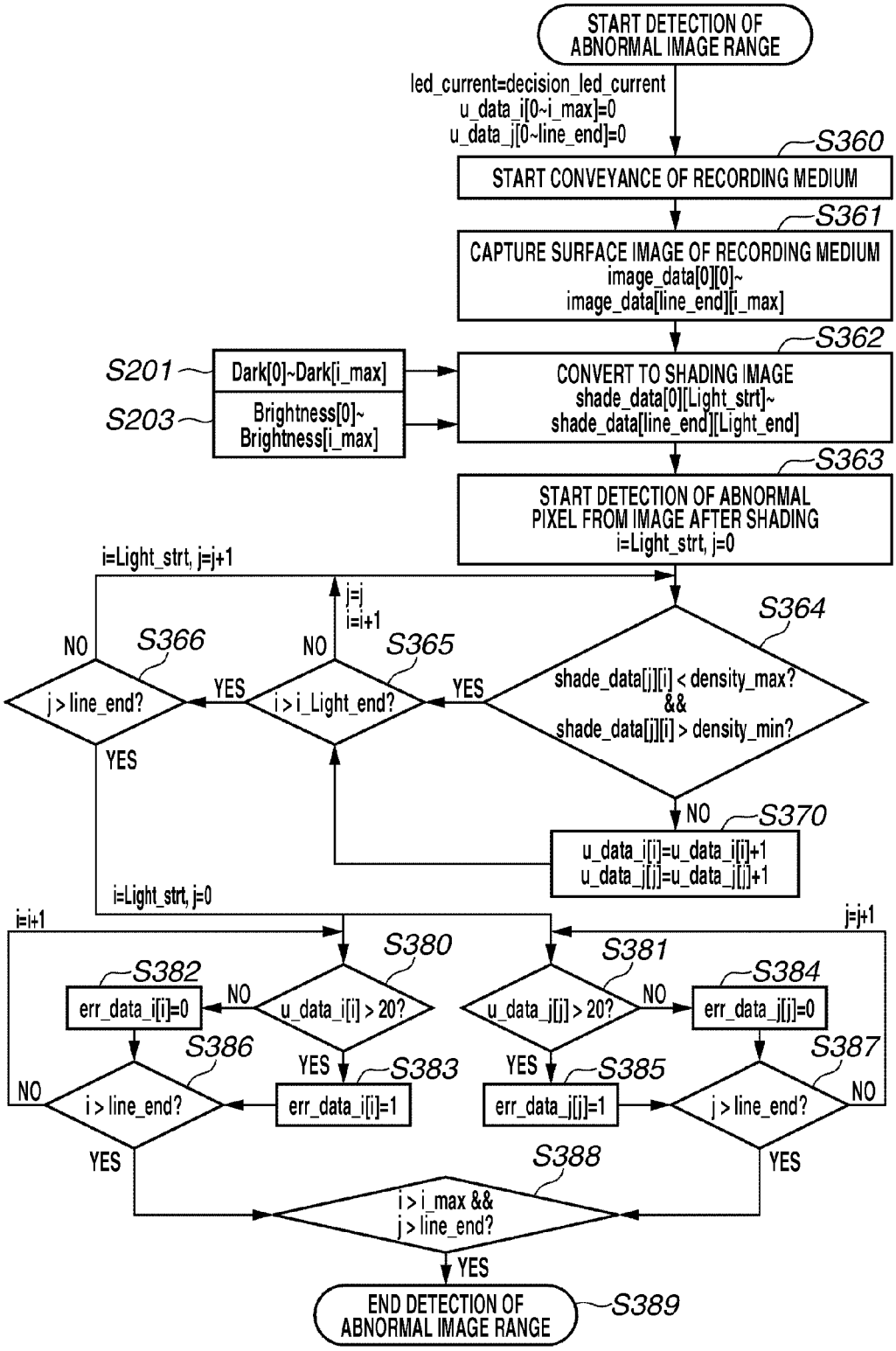
FIG. 8 is a flow chart describing a method of detecting an abnormal pixel region.

A method of detecting an abnormal image region from the surface image of the recording medium P subjected to the shading correction will be described using a flow chart in FIG. 8. The values of the arrays for detecting abnormal pixels "u_data_i" and "u_data_j" are initialized. In step 360, the conveyance of the recording medium P is started. In step 361, the surface of the conveyed recording medium P is captured by the line sensor 43 in the recording medium imaging device 40 and output to arrays "image_data [0] [0]" to "image data [line_end] [i_max]."

In step 362, the image captured in step 361 is subjected to shading correction and output to arrays for an image "shade_data [0] [Light_strt]" to "shade_data [line_end] [Light_end]" after the shading correction is performed. The shading correction uses the arrays for a black reference "Dark [0]" to "Dark [i_max]" and the arrays for light quantity correction "Brightness [0]" to "Brightness [i_max]" obtained in steps 201 and 203 respectively. The shading correction can be performed by using a general method, so that the description thereof is omitted.

In step 363, loop variables "i" and "j" are initialized to the head value of loop handling for detecting an abnormal image. In step 364, an abnormal image in the image information after the shading correction is detected. In the present exemplary embodiment, two thresholds "density_max" and "density_min" are used to identify an abnormal image. This is because pixels of the surface image affected by dirt or scratches on the surface of the recording medium P or foreign matters are detected. More specifically, this is because it is counted whether image information subjected to the shading correction exceeds a predetermined brightness. Although a specific value is not given in FIG. 8, in the present exemplary embodiment, the following values are used as examples of predetermined thresholds:

$$density_max=240 \quad (7)$$

$$density_min=15 \quad (8).$$

Although the present exemplary embodiment uses the values (7) and (8), the present exemplary embodiment is not limited to the above values as long as there is no problem with accuracy in determining the recording medium P.

In step 364, if image information subjected to shading correction "shade_data [i] [j]" exceeds the equation (7) or does not exceed the equation (8), it is determined that the image information "shade_data [i] [j]" after the shading is corrected is an abnormal pixel. The arrays for detecting abnormal pixels "u_data_i[i]" and "u_data_j[j]" are set to "1." In step 364, if image information "shade_data [i] [j]" after the shading is corrected is not more than the equation (7) and not less than the equation (8), it is determined that the image information "shade_data [i] [j]" after the shading is corrected is a normal pixel. The arrays "u_data_i[i]" and "u_data_j[j]" for detecting abnormal pixels are set to "0", which is an initial value.

After the abnormal pixel is confirmed in step 364, in step 365, it is determined whether the number of abnormal pixels reaches the number of ending the detection as to one line. If the number of abnormal pixels does not reach the number of ending the detection as to one line (NO in step 365), the loop variable "i" is increased. Then, the proceeding returns to step 364 to detect the following abnormal pixel. If the number of abnormal pixels reaches the number of ending the detection as to one line (YES in step 365), in step 366, it is determined whether the number of abnormal pixels reaches the number of all the measurement lines to be detected. If the number of abnormal pixels does not reach the number of ending detection (NO in step 366), the loop variable "j" is increased and the loop variable "i" is initialized. Then, the proceeding returns to step 364 to detect the following abnormal pixel. If the number of abnormal pixels reaches the number of all the measurement lines to be detected (YES in step 366), the loop variables "i" and "j" are initialized. Then, the processing proceeds to steps 380 and 381.

In steps 380 and 381, the number of detected abnormal pixels is confirmed with respect to the array "u_data_i" for detecting abnormal pixels for the column of image information, and the array "u_data_j" for the row of image information. In the present exemplary embodiment, the comparison value for the number of detected abnormal pixels is set to 20, for example. For the column or the row including abnormal pixels, if the number of abnormal pixels exceeds the comparison value (YES in steps 380 and 381), it is determined that the array of the column or the row including the abnormal pixels could not have captured a normal image for some reason such as dirt or scratches on the surface of the recording medium P or foreign matters.

Accordingly, the column or the row exceeding the comparison value is considered unsuitable for the data region used for determining the surface property of the recording medium P, and "err_data_i[i]" or "err_data_j[j]" is set to "1", that is, it is determined as abnormal. If the number of abnormal pixels does not exceed the comparison value (NO in steps 380 and 381), in steps 382 and 384, the column or the row is considered suitable for the data region used for determining the kind of the recording medium P, and "err_data_i[i]" or "err_data_j[j]" is set to "0", that is, it is determined as normal.

In step 388, it is determined whether all the comparisons are finished. If it is determined that steps 386 and 387 are both finished, the detection of the abnormal image region is ended. In the present exemplary embodiment, although the comparison value is set to 20, the comparison value is not limited to this value.

Figure 9:
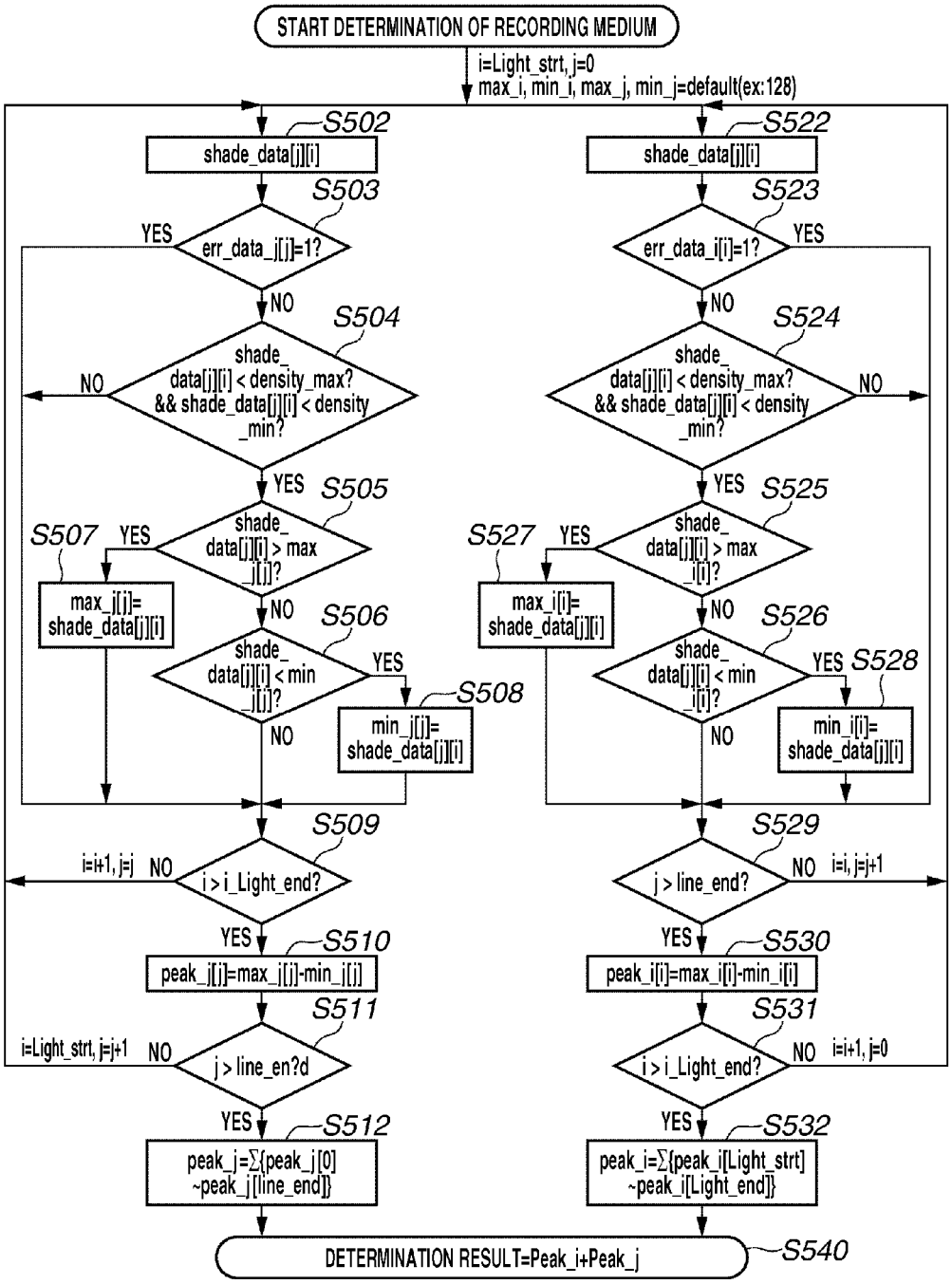
FIG. 9 is a flow chart describing a method of determining the kind of the recording medium.

A method of determining the kind of the recording medium P is described with reference to FIG. 9. The loop variables "i" and "j" and the arrays "max_i[i], max_j[j], min_i[i], and min_j[j]" for storing the maximum value and the minimum value obtained from image information used in determination are initialized. In steps 502 and 522, shading correction data "shade[i] [j]" of surface image of the recording medium P is subjected to a determination process. The loop variables "i"

and "j" are values indicating the column and the row of image information respectively. The loop variables "i" and "j" indicate the column and the row respectively and are different. However, both can be processed in a similar manner, so that the determination process on the row "j" side is described.

In step 502, the shading correction data of surface image of the recording medium P is called and, in step 503, it is determined whether the row "j" is an abnormal image region. If it is determined that err_data_j[j]=1 and the row "j" is the abnormal image region (YES in step 503), the processing proceeds to step 509 without performing a step for determination. If it is determined that the row "j" is not the abnormal image region (NO in step 503), in step 504, it is determined whether the image information is less than "density_max" which is an abnormal pixel criterion, or exceeds "density_min." If the image information coincides with one of the abnormal pixel criteria (YES in step 504), the proceeding proceeds to step 509 without performing a step for determination.

If the image information coincides with neither of the abnormal pixel criteria (NO in step 504), it is determined that the image information is a normal pixel. In step 505, it is determined whether the value "shade_data [i] [j]" is the maximum value in the region where determination is ended in the loop process of the row "j", which is the image subjected to the shading correction. If the value is the maximum value (YES in step 505), in step 507, the value "shade_data [i] [j]" is updated as the maximum value and stored in the maximum-value array "max_j[j] of the row "j." Then, the processing proceeds to step 509. If the value "shade_data [i] [j]" is not the maximum value (NO in step 505), in step 506, it is determined whether the pixel information is the minimum value in the region where determination is ended in the loop process of the row "j", which is the image subjected to the shading correction. If the pixel information is the minimum value (YES in step 506), in step 508, the value "shade_data [i] [j]" is updated as the minimum value and stored in the minimum-value array "min_j[j] of the row "j." If the value "shade_data [i] [j]" is neither maximum nor minimum, the proceeding proceeds to step 509.

In step 509, it is determined whether the column "i" reaches "Light_end" in the image range "j" out of the value "shade_data [i] [j]" currently confirmed. If the column "i" does not reach "Light_end" (NO in step 509), the column "i" is increased by one as i=i+1, and the processing returns to step 502 to successively perform the similar confirmation. If the column "i" reaches "Light_end" (YES in step 509), it is determined that the confirmation of the maximum and the minimum value in the region of the row "j" is ended. The processing proceeds to step 510. In step 510, the maximum peak width of the row "j" is calculated from the maximum-value array "max_j[j] and the minimum-value array "min_j[j] that were determined. The array storing the maximum peak width becomes "peak[j]."

In step 511, it is determined whether the number of the row "j" currently confirmed is maximum. If the number of the row "j" is not maximum (NO in step 511), the loop variable of the column "i" is returned to the head number and the loop variable "j" of the row "j" is increased by one as j=j+1, and the processing returns to step 502 to successively perform the similar confirmation. If the row "j" in the image range is maximum (YES in step 511), the processing proceeds to step 512. In step 512, the maximum peak widths "peak[j]" of the rows "j" which have been previously confirmed are obtained.

In the present exemplary embodiment, the following calculation is made:

$$\text{Peak_j}=\text{peak_j}[0]+\text{peak_j}[1]+\text{peak_j}[2]+\ldots+\text{peak_j}[\text{line_end}-1]+\text{peak_j}[\text{line_end}] \quad (9).$$

The maximum peak widths "peak[j]", which is the results calculated by the equation (9), is an accumulation of roughness of surface property obtained from the surface image of the recording medium P subjected to shading correction. In the present exemplary embodiment, "peak[j]" is one of the determination results used in step 540 described later. As far as the column "i" side is concerned, even if "j" is replaced with "i", the process can be carried out by the steps similar to the row "j" side, so that the description thereof is omitted.

In step 540, the calculation results "Peak_i" and "Peak_j" obtained in steps 512 and 532 are summed up and the image forming condition control unit 90 is notified of the determination result of the surface image on the recording medium P. The image forming condition control unit 90 determines the kind of the recording medium P according to the determination result of the surface image of the recording medium P and optimizes the mage forming condition for the image forming apparatus.

Figure 10:
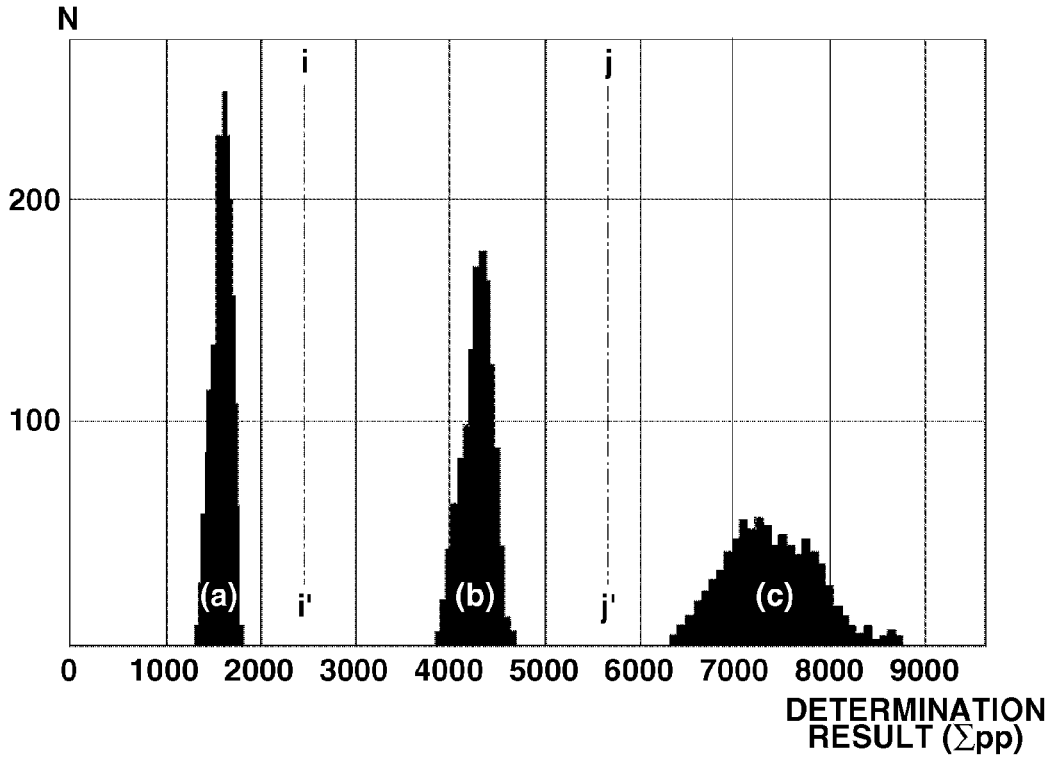
FIG. 10 is a graph describing the determination result of the surface image of the recording medium.

FIG. 10 illustrates an example of the determination result of the surface image of the recording medium P. The graph in FIG. 10 illustrates results obtained from the surface measurement of three typical kinds of 500 or more recording mediums P each weighing 105 g and the determination of the kind of the mediums. In FIG. 10, the weight is the same among (a), (b), and (c), however, it can be seen that the roughness of surface property is greatly different. In such a distribution, determination thresholds of boundaries "i-i'" and "j-j'" are provided to enable the determination of the kind of the recording medium P.

Through the abovementioned process, the surface property of the recording medium P is detected from the surface image and the pixels which seem to be affected due to some abnormality are removed, thereby allowing the determination of the kind of the recording medium P. This can minimize the loss of accuracy in determining the recording medium P due to an abnormal pixel, so that the recording medium P can be accurately determined.

The configuration of a second exemplary embodiment can be implemented in FIGS. 1 to 3 described in the first exemplary embodiment, so that the description thereof is omitted. The components described in the first exemplary embodiment are given the same reference numerals to omit the description thereof.

Figure 11A:
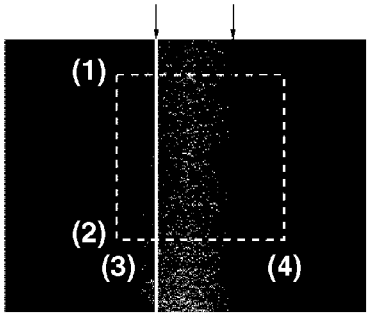
FIGS. 11A, 11B, 11C and 11D are surface images and graphs which show a method of detecting an abnormal pixel region according to a second exemplary embodiment.
Figure 11B:
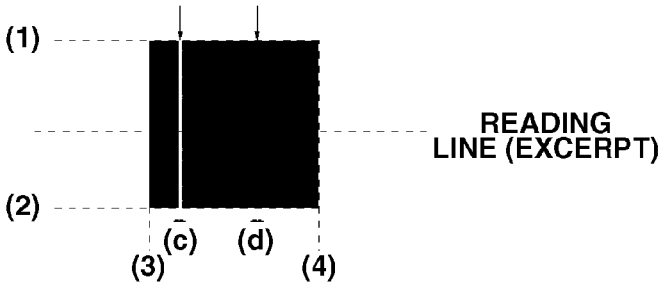

A method of extracting an abnormal pixel according to the present exemplary embodiment is described with reference to FIG. 11. FIG. 11A illustrates the surface image of the recording medium P. FIG. 11B illustrates an image in which the region indicated by the dotted line in the surface image is subjected to shading correction. FIGS. 11A and 11B illustrate abnormal pixels existing over all in the conveyance direction as indicated by the arrows. As illustrated in FIGS. 11A and 11B, if abnormal pixels exist under the influence of foreign matters such as dust or scratches, adjacent pixels may also be affected by the abnormal pixels. In the present exemplary embodiment, a method is described which appropriately detects also the pixels adjacent to such an abnormal pixel. An abnormal pixel obviously different from unevenness in light quantity as illustrated in the portions indicated by the arrows in FIG. 11A is not positively subjected to a shading correction. Accordingly, such an abnormal pixel remains in the conveyance direction on the surface image subjected to the shading correction as illustrated in FIG. 11B.

Figure 11C:
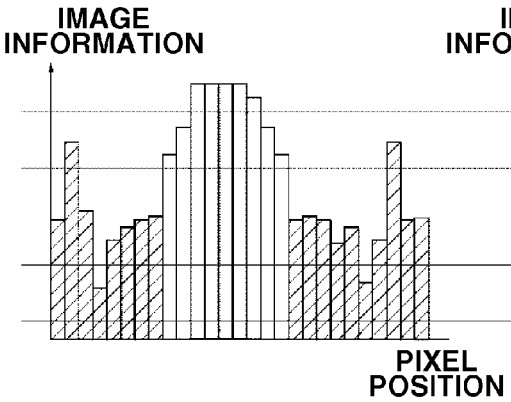
Figure 11D:
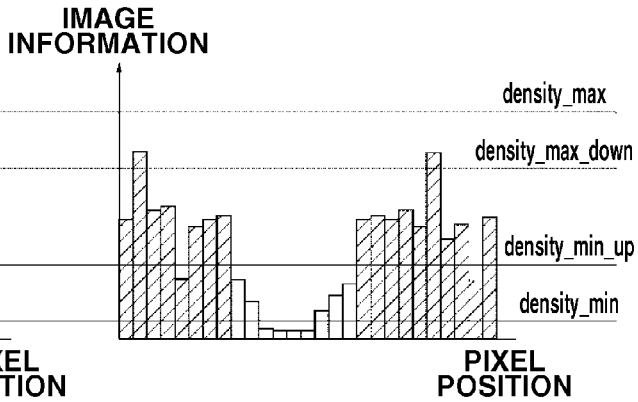

FIGS. 11C and 11D are graphs in which information about surface image of the recording medium P is expanded such that the region of a white portion indicated by the arrow is taken as (c) and the region of a black portion indicated by the arrow is taken as (d) and converted into data for each pixel. The graphs indicate "density_max" and "density_min" which are determination thresholds of an abnormal pixel used in the first exemplary embodiment. The graphs also indicate "density_max_down" and "density_min_up" which are used as thresholds for confirming a pixel adjacent to an abnormal pixel, described below in FIG. 12. In FIGS. 11C and 11D, normal image information is indicated by bar charts with oblique lines, and a portion determined to be an abnormal pixel is indicated by white bar charts.

Figure 12:
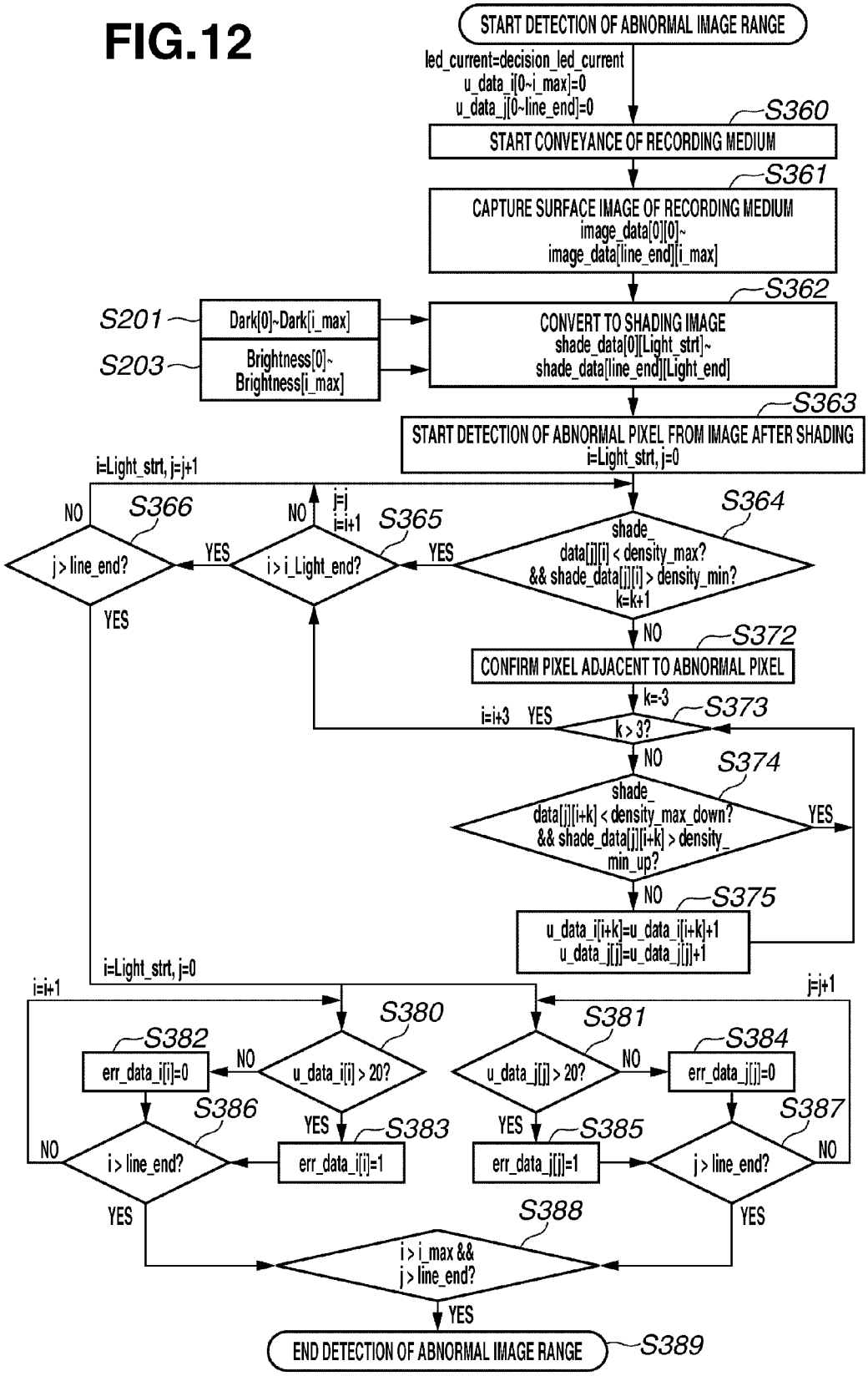
FIG. 12 is a flow chart describing a method of detecting the abnormal pixel region in the second exemplary embodiment.

A method of determining an abnormal pixel used in FIGS. 11C and 11D will be described below using a flow chart in FIG. 12. The steps similar to those in the first exemplary embodiment in FIG. 8 are denoted by the same reference characters and the description thereof is omitted. Steps 360 to 364 are similar to those in FIG. 8, so that the description thereof is omitted. Steps 365 to 389 are also similar to those in FIG. 8, so that the description thereof is omitted. Steps 372 to 375 show the characteristics of the present exemplary embodiment and are described below.

In step 364, if it is determined that image information is an abnormal pixel, in step 372, a loop variable k used for confirming a pixel adjacent to the abnormal pixel is initialized and k=−3 is substituted therefor. This is because ±3 pixels are confirmed with respect to the pixel detected as abnormal in the present exemplary embodiment. Although the number of adjacent pixels to be confirmed in the present exemplary embodiment is set to ±3, for example, the value may be arbitrarily set. In step 373, the number of the current loop processes is confirmed. If the number of the current loop processes is +3 pixels or less (NO in step 373), the loop process is continued.

In step 374, it is determined whether the image data subjected to shading correction is "density_max_down" or less or "density_min_up" or more. The above thresholds for confirmation about "density_max_down" and "density_min_up" are made different from thresholds for a typical abnormal pixel in order to extract the pixel determined to be affected by the image information detected as an abnormal pixel. More specifically, "density_max_down" is the upper limit value smaller than "density_max" and "density_min_up" is the lower limit value greater than "density_min." Although the thresholds "density_max_down" and "density_min_up" are not expressed in FIG. 12, a comparison is performed by the following values in the present exemplary embodiment:

$$density_max_down=208 \quad (10)$$

$$density_min_up=47 \quad (11).$$

If it is determined that the image data is equal to the value (10) or less and the value (11) or more (YES in step 374), it is determined that the image data is not affected by the image information detected as an abnormal pixel. The arrays "u_data_i" and "u_data_j" are not subjected to further process and the following process is performed with k=k+1. If it is determined that the image data is equal to the value (10) or more and the value (11) or less (NO in step 374), in step 375, the arrays for detecting abnormal pixels "u_data_i[i+k]" and "u_data_j[j]" become "1." The processing returns to step 373 with k=k+1 to determine the number of loop processes.

In step 373, if it is confirmed that the loop process is finished and if a determination as to whether the pixel adjacent to an abnormal pixel is an abnormal pixel is finished, the processing proceeds to step 365 with i=i+3 to avoid the determination about a pixel adjacent to an abnormal pixel. After the above steps are performed, the detection of the abnormal image range is finished and the kind of the recording medium P is determined based on the obtained information of surface property of the recording medium P.

Thus, if it is determined that a normal image could not have been captured for some reason or other such as dirt or scratches on the surface of the recording medium P or foreign matters, the threshold for a pixel adjacent to an abnormal pixel is changed to determine the abnormal pixel. Therefore, it is possible to avoid use of the adjacent pixel affected by the abnormal pixel in determining the kind of the recording medium P. Thus, the kind of the recording medium P can be determined by removing the abnormal pixel and the pixel affected by the abnormal pixel from the surface image of the recording medium P, which improves accuracy in the determination of the recording medium P.

In the present exemplary embodiment, while the new threshold for confirmation is described in a case where both the upper and the lower limit value of the normal threshold are changed, only one of the upper and the lower limit value may be changed to be used as the new threshold for confirmation.

The configuration of a third exemplary embodiment can be implemented in FIGS. 1 to 3 described in the first exemplary embodiment, so that the description thereof is omitted. The components described in the first and the second exemplary embodiment are given the same reference numerals to omit the description thereof.

Figure 13A:
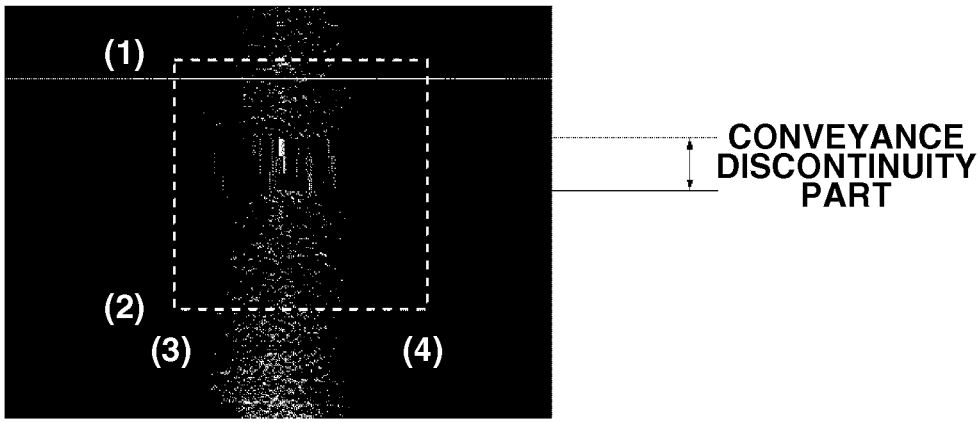
FIGS. 13A and 13B are surface images illustrating the discontinuous conveyance in a third exemplary embodiment.
Figure 13B:
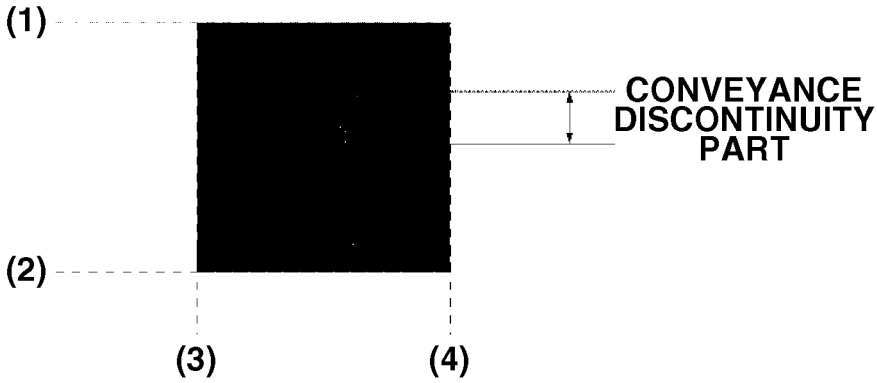

A method of extracting an abnormal pixel according to the present exemplary embodiment is described with reference to FIG. 13. FIG. 13A illustrates the surface image of the recording medium P. FIG. 13B illustrates an image in which the region indicated by the dotted line in the surface image is subjected to shading correction. In the region indicated as a conveyance discontinuity part in FIGS. 13A and 13B, defective reading occurs due to unevenness in the conveyance speed of the recording medium P, or the recording medium P is temporarily stopped during conveyance. In the present exemplary embodiment, the line sensor is used to capture the surface image, so that if the defective conveyance occurs, a region appears where a normal image cannot be captured as illustrated in FIGS. 13A and 13B. A method will be described below which removes the above region from the surface image used in determining the kind of the recording medium P.

Figure 14:
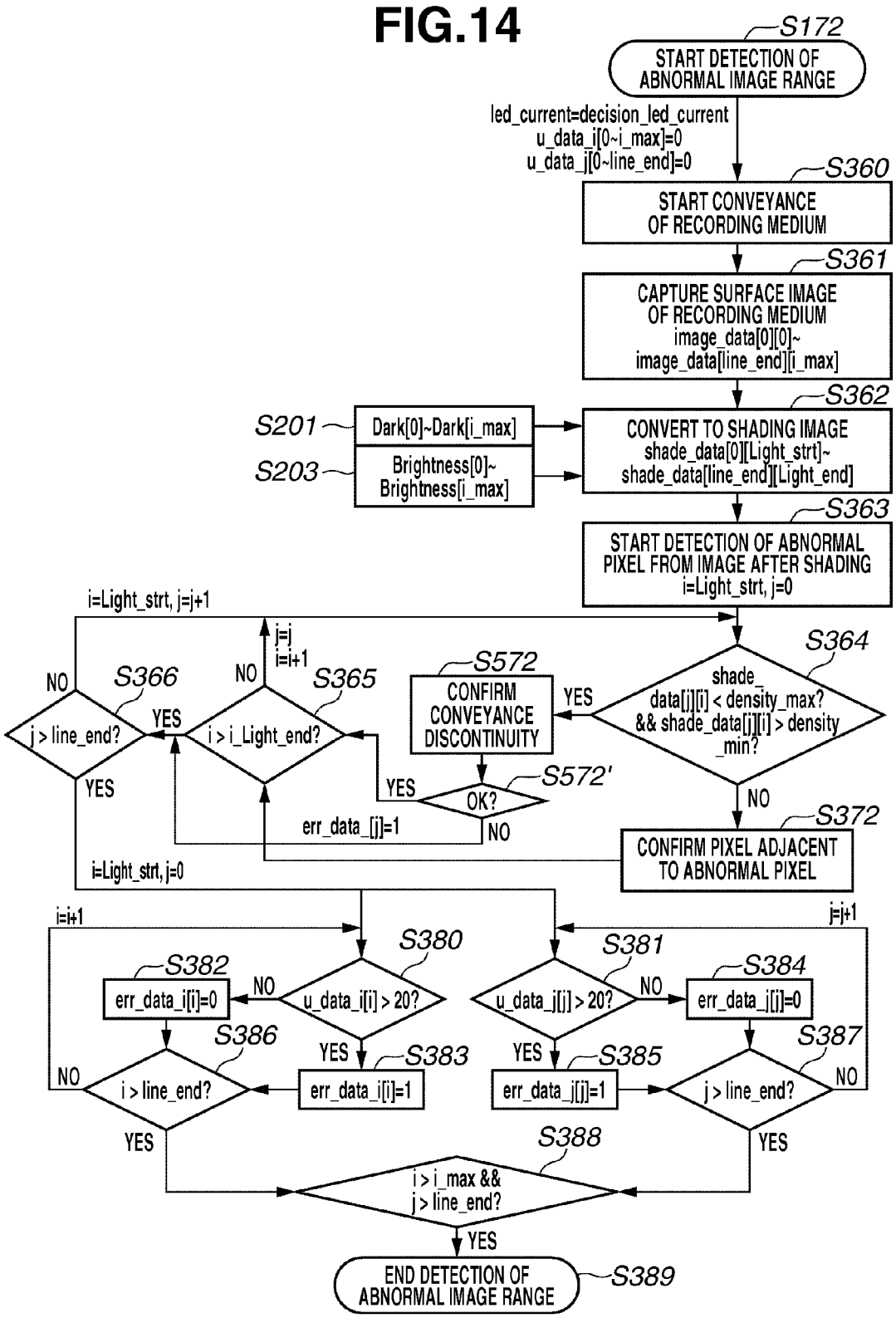
FIG. 14 is a flow chart describing a method of detecting the abnormal pixel region in the third exemplary embodiment.

A method of detecting an abnormal pixel region when the defective conveyance occurs, is described with reference to FIG. 14. The steps similar to those in the second exemplary embodiment in FIG. 12 are denoted by the same reference characters to omit the description thereof. In FIG. 14, the steps excluding steps 572 and 572' are similar to those in FIG. 12, so that the description thereof is omitted. Steps 572 and 572' are described in detail in FIG. 15.

Figure 15:
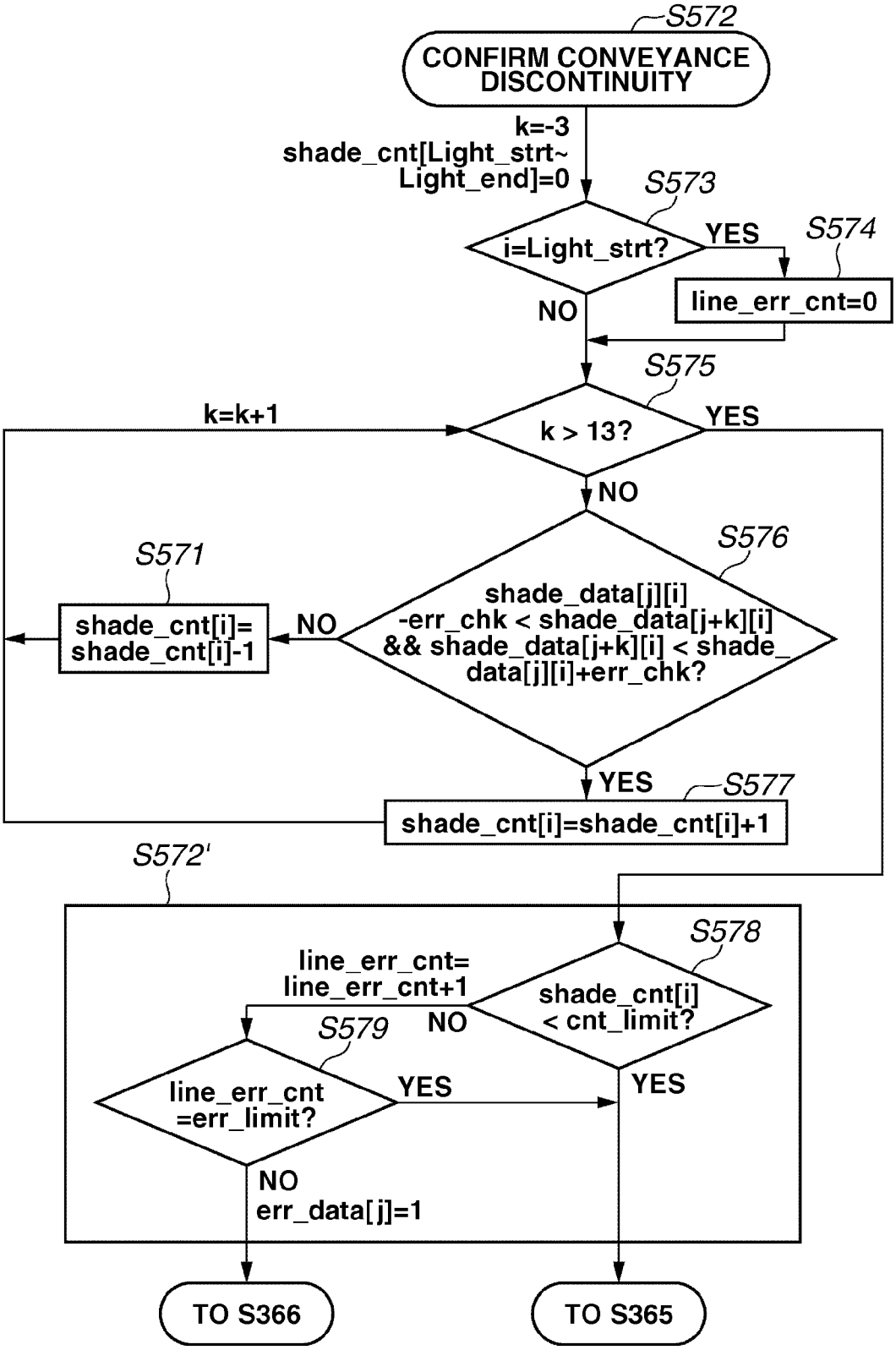
FIG. 15 is a flow chart describing a method of confirming the discontinuous conveyance in the third exemplary embodiment.

A conveyance discontinuity determination is described below with reference to FIG. 15. In step 572, the conveyance discontinuity determination is started on the image subjected to shading correction determined not as an abnormal pixel. The loop variable "k" and arrays for counting continuous pixels "shade_cnt[Light_strt to Lignt_end]" are initialized in determining conveyance discontinuity. In the present exemplary embodiment, a pixel is compared with the pixel existing on the third line previous thereto, so that the loop variable k=−3 is taken as an initial value. Each array for counting continuous pixels "shade_cnt[i]" is initialized and 0 is substituted to perform counting. While a pixel is compared with the pixel existing on the third line previous thereto as an example, the value may be arbitrarily set.

The processing proceeds to step 573 to confirm whether the column number "i" of the image subjected to shading correction which is being currently confirmed is "Light_strt." If the column number "i" of the image subjected to shading correction is "Light_strt" (YES 573), the processing proceeds to step 574 to initialize the value "line_err_cnt" used in the conveyance discontinuity determination as 0 and the processing proceeds to step 575. If the column number "i" of the image subjected to shading correction is not "Light_strt" (NO 573), the value "line_err_cnt" is not initialized and the processing proceeds to step 575. In step 575, it is determined whether the loop variable "k" reaches the upper limit criterion of the conveyance discontinuity determination. In the present exemplary embodiment, k>13 is taken as the criterion and 16 lines are confirmed from the aforementioned k=−3 to k=13. While the loop variable "k" is set to 13 as an example, it may be arbitrarily set.

The number of the confirmed lines is examined in step 575. If the number of the lines does not reach the upper limit (NO in step 575), in step 576, continuity of the surface image is confirmed in the range of three former pixels and 13 latter pixels in the conveyance direction of the image subjected to shading correction which is being currently confirmed. While the predetermined number of continuously adjacent pixels is the three former pixels and 13 latter pixels, the number of pixels is not limited to those but may be arbitrarily set. In step 576, continuity is confirmed based on whether the data of the surface image falls within the range of ±err_chk with respect to the image subjected to shading correction which is being currently confirmed, using a difference in brightness between the compared pixels. If the data of the surface image falls within the range of ±err_chk (YES in step 576), the processing proceeds to step 577 and the count of the array for counting continuous pixels "shade_cnt[i]" is increased by one. If the data of the surface image does not exist within the range of ±err_chk (NO in step 576), the processing proceeds to step 571 and the count of the array for counting a continuous pixel "shade_cnt[i]" is decreased by one. This avoids an erroneous detection when almost the same image data continues to appear on the recording medium P showing high smoothness. While a specific value is not expressed in FIG. 15, the value "err_chk=5" is used to perform confirmation.

In steps 571 or 577, the count of the array for counting continuous pixels "shade_cnt[i]" is increased and decreased and then the processing returns to step 575. In step 575, the number of the confirmed lines is examined and if the number of the confirmed lines reaches the upper limit (YES in step 575), the processing proceeds to step 578. In step 578, the value of the array for counting a continuous pixel "shade_cnt [i]" is compared with a threshold for determining continuity "cnt_limit." While a specific value is not shown in FIG. 15, the value of 12 which is ¾ of the number of lines for confirmation is used.

If the value of the array for counting a continuous pixel "shade_cnt[i]" exceeds the threshold for determining continuity "cnt_limit" (NO in step 578), the value "line_err_cnt" is increased by one and the processing proceeds to step 579. In step 579, it is determined whether the value "line_err_cnt" which counts the discontinuity of conveyance reaches "err_limit." If the value "line_err_cnt" which counts the discontinuity of conveyance does not reach "err_limit" (YES in step 579), the processing proceeds to step 365. If the value exceeds "err_limit" (NO in step 579), "err_data_j[j] becomes "1" and the processing proceeds to step 366. In step 578, if the value of the array for counting a continuous pixel "shade_cnt [i]" does not exceed the threshold for determining continuity "cnt_limit" (YES in step 578), the processing proceeds to step 365. After the above steps are performed, the detection of the abnormal image range is finished and the kind of the recording medium P is determined based on the obtained information of surface property of the recording medium P.

As described above, even if it is determined that there is a portion where a normal image has not been obtained due to the defective conveyance of the recording medium P or unevenness in the conveyance speed thereof, the region determined as an abnormal pixel can be removed from the surface image to be used for determining the kind of the recording medium P, which improves accuracy in the determination of the recording medium P.

The configuration of a fourth exemplary embodiment can be implemented in FIGS. 1 to 3 described in the first exemplary embodiment, so that the description thereof is omitted. The components described in the first to the third exemplary embodiment are given the same reference numerals and the description thereof is omitted.

In the first to the third exemplary embodiment, the method is described which removes the abnormal pixel region from the surface image to be used for determining the kind of the recording medium P. If it is found unable to obtain the number of pixels required for determining the kind of the recording medium P because the abnormal pixel region is increased for some reason, the region of the surface image used for determining the kind of the recording medium P is expanded. In the present exemplary embodiment, a method is described below which obtains the number of pixels required for determining the kind of the recording medium P by expanding the region of the surface image.

Figure 16A:
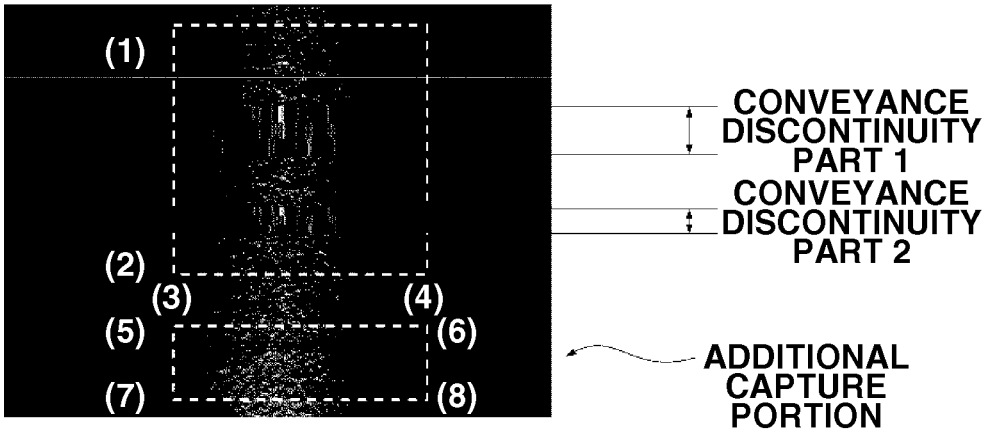
FIGS. 16A and 16B illustrate the addition of the surface image in a fourth exemplary embodiment.

FIG. 16A illustrates the surface image of the recording medium P. A region encircled by dotted lines (1) to (4) is the image region to be used for determining the kind of the recording medium P. There are two conveyance discontinuity portions in the region encircled by dotted lines (1) to (4). If the abnormal image regions are removed by the abnormal image region detection, the number of pixels becomes short in determining the kind of the recording medium P. For this reason, a region encircled by dotted lines (5) to (8) is newly added as the image region used for determining the kind of the recording medium P.

Figure 16B:
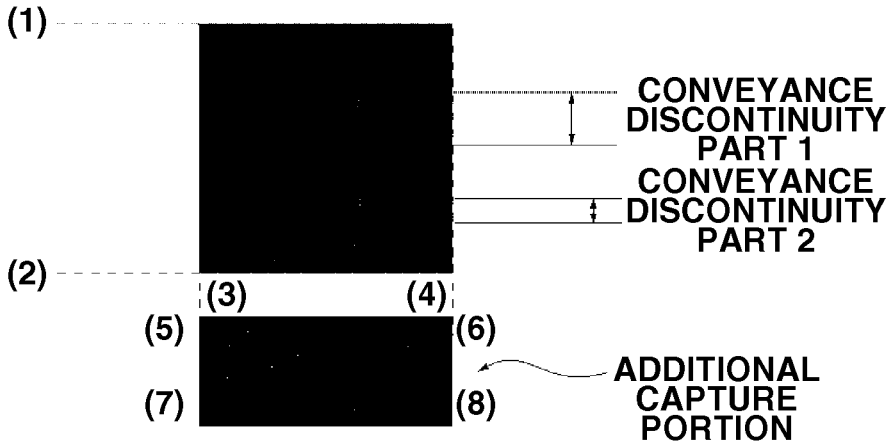

FIG. 16B illustrates an image in which the regions encircled by the dotted lines in FIG. 16A are subjected to shading correction. As described in the first exemplary embodiment, the surface image of the recording medium P is formed of 230×230 pixels (52900 pixels). In the present exemplary embodiment, the surface image is additionally captured when the number of remaining pixels in which the abnormal image region is removed from the surface image is decreased to 80% or less or 42320 pixels or less. In view of possibility that the abnormal image region is also included in the added surface image, the number of pixels being three times the number of required pixels is captured.

As an example in the present exemplary embodiment, the surface image is additionally captured when the number of remaining pixels in which the abnormal image region is removed from the surface image is decreased to 80% or less. However, the number of remaining pixels is not limited to 80% or less, but may be arbitrarily set. Furthermore, while the number of pixels for the added surface image is three times the number of required pixels, the number of pixels is not limited to three times, but may be arbitrarily set.

Figure 17:
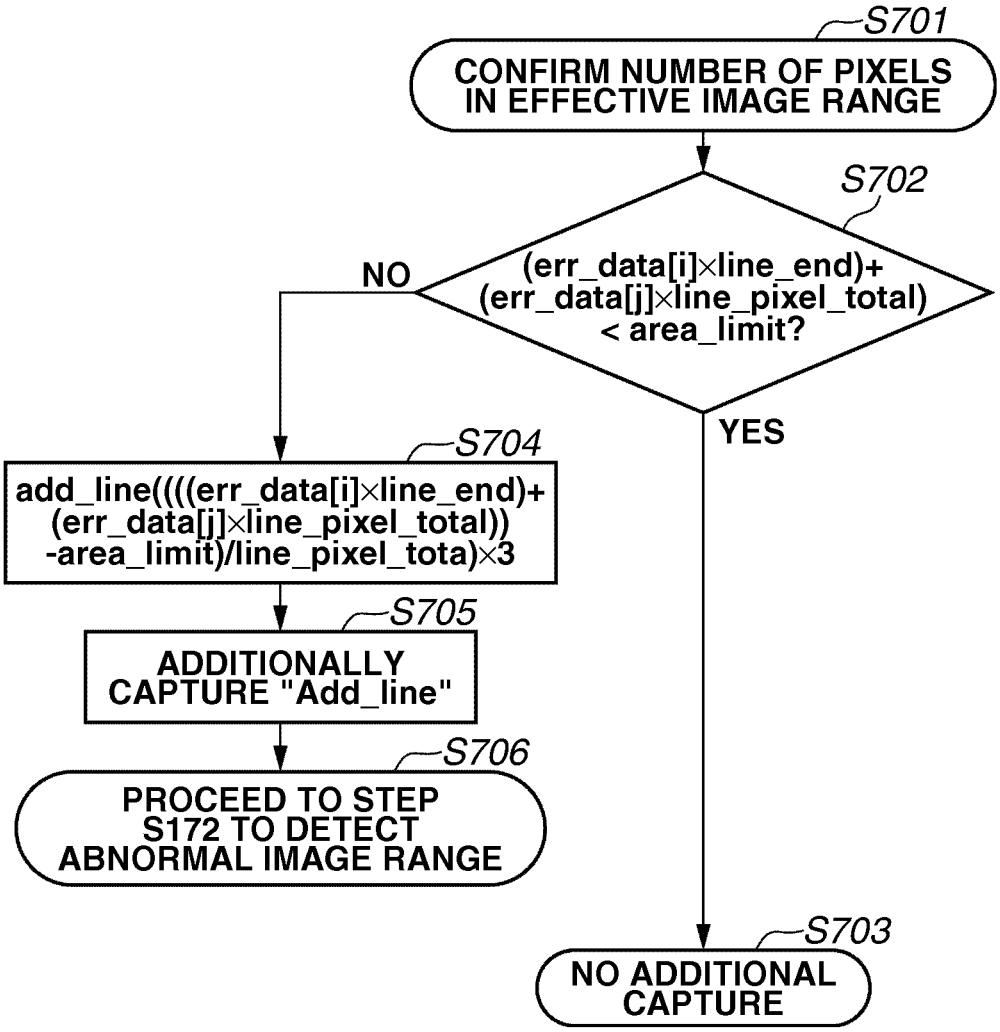
FIG. 17 is a flow chart describing a method of confirming the number of pixels in the surface image in the fourth exemplary embodiment.

A method of adding the image region used for determining the kind of the recording medium P is described with respect to a flow chart in FIG. 17. In step 701, the confirmation of the number of pixels in the effective image region is started. In step 702, the total number of pixels of the rows or the columns in the total of "err_data_i[i]" and "err_data_j[j]" indicating the abnormal image region is calculated and compared with the threshold "area_limit" for confirming the number of pixels in the effective image region.

The abnormal image regions "err_data_i[i]" and "err_data_j[j]" are obtained from the following equations:

$$\Sigma(\text{err_data_i[i]})=\text{err_data_i[Light_strt]}+\text{err_data_i[Light_strt+1]}+\ldots\text{err_data_i[Light_end]} \quad (12)$$

$$\Sigma(\text{err_data_j[j]})=\text{err_data_j[0]}+\text{err_data_j[1]}+\ldots\text{err_data_j[line_end]} \quad (13).$$

The threshold "area_limit" can be obtained from the following equation:

$$\text{area_limit}=((\text{Light_end}-\text{Light_strt})*\text{line_end})*1/4 \quad (14).$$

It is determined whether the sum total of the equations (12) and (13) reaches the equation (14) in step 702. If the sum total does not reach the threshold "area_limit" (NO in step 702), the processing proceeds to step 703 in which the surface image is not additionally captured. If the sum total reaches the threshold "area_limit" (YES in step 702), in step 704, the region of the additionally captured surface image is calculated.

In the present exemplary embodiment, as shown in step 704, a region three times as large as the number of short measurement lines is obtained as the region of the surface image to be additionally captured. Since an abnormal pixel may exist even in the additionally captured surface image, the region is expanded to a range of the number of pixels which is greater than the number of effective pixels required for determining the kind of the recording medium P and, in step 705, the expanded region "add_line" is captured. After the surface image of the recording medium P is captured in step 705, the processing proceeds to step 172 to detect the abnormal image region in step 706 while retaining the detection results.

The detection result of the surface property of the recording medium P newly detected in step 172 and subsequent steps is put together. The detection result is used as information about the surface property of the recording medium P to determine the kind of the recording medium P. To confirm the number of pixels in the effective image region based on the second detection result of the abnormal image region, the threshold "area_limit" in the equation (14) may also be calculated from the number of lacking pixels.

Thus, even if a large number of abnormal pixels are detected and removed from the image region to be used for determining the kind of the recording medium P, the number of pixels required for determination can be secured by adding the region of the surface image to be used for determination, so that accuracy in determining the kind of the recording medium P can be improved.

The configuration of a fifth exemplary embodiment can be implemented in FIGS. 1 to 3 described in the first exemplary embodiment, so that the description thereof is omitted. The components described in the first to the fourth exemplary embodiment are given the same reference numerals and the description thereof is omitted.

In the fourth exemplary embodiment, a method is described which expands the region of the surface image if it is found unable to obtain the number of pixels required for determining the kind of the recording medium P because the abnormal pixel region is significantly increased for some reason. However, it may be difficult to expand the region of the surface image depending on conditions such as a position where the recording medium imaging device is arranged. For example, if the recording medium imaging device is arranged near a registration roller for temporarily stopping the recording medium P in a general image forming apparatus, a sufficient region cannot be secured in expanding the region of the surface image in the conveyance direction. In the present exemplary embodiment, a method is described which secures the region of the surface image even if it is thus difficult to add the region of the surface image.

Figure 18:
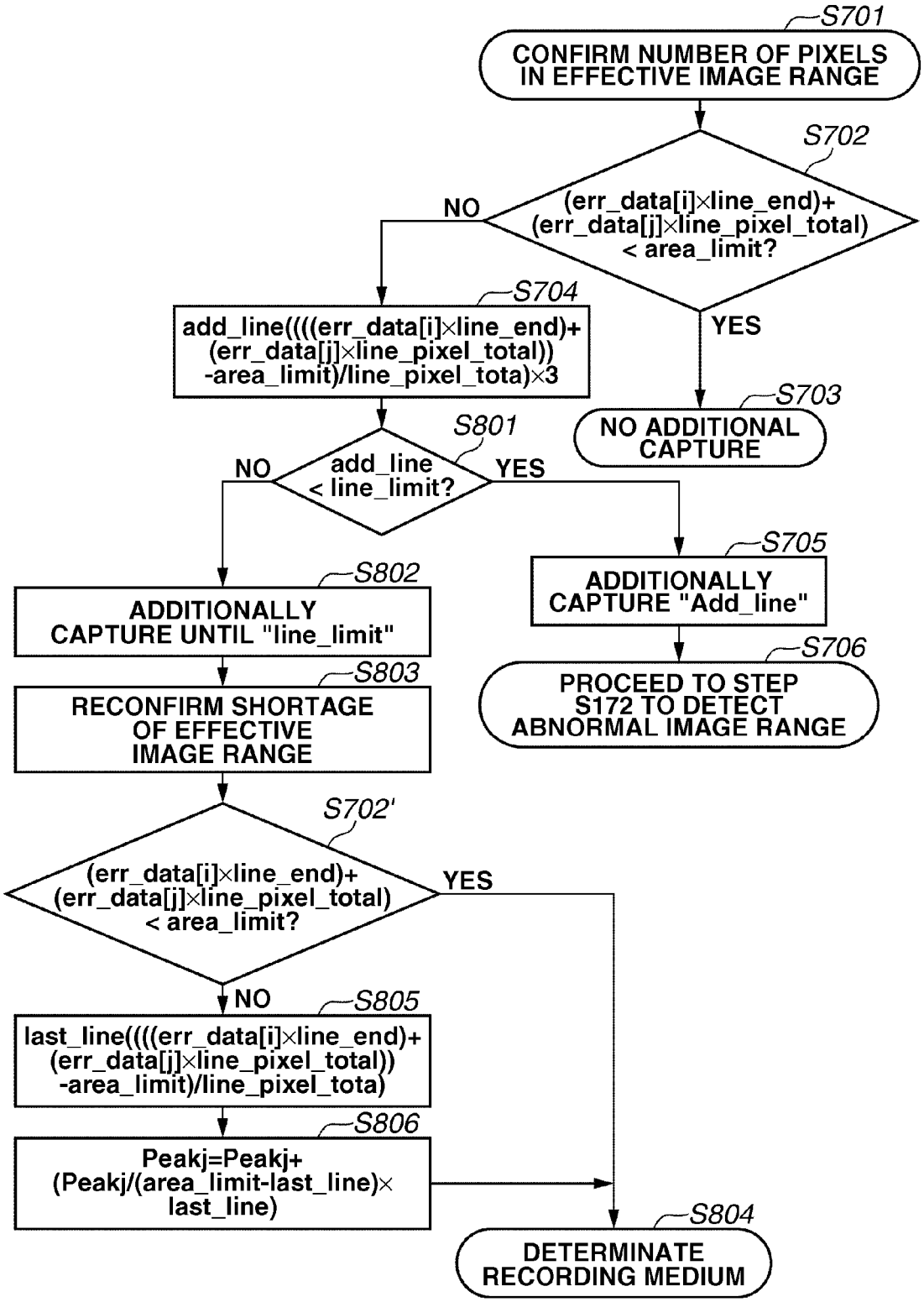
FIG. 18 is a flow chart describing a method of adding the surface image in the fourth exemplary embodiment.

A method of adding the region of the surface image used for determining the kind of the recording medium P is described below with reference to FIG. 18. In step 701, the confirmation of the number of pixels in the effective image region is started. In step 702, if the sum total exceeds the threshold "area_limit" (NO in step 702) in the equations (12) to (14), in step 704, the region of the surface image to be additionally captured is calculated. In the present exemplary embodiment, as shown in step 704, a region three times as large as the number of short measurement lines is obtained as the region of the surface image to be additionally captured.

In step 704, "add_line" is calculated and then the sum total of "add_line" is compared with "line_limit", which is the region where the recording medium P can be captured on the conveyance path in step 801. If the number of "add_line" does not exceed "line_limit" (YES in step 801), in step 705, "add_line" is captured. If the number of "add_line" exceeds "line_limit" (NO in step 801), in step 802, the surface image extending to "line_limit" is captured. In step 803, a shortage of region of the surface image is compensated.

In order to confirm the number of lacking lines, the number of lacking lines "ave_num" is calculated by the following equation:

$$\text{ave_num}=\text{last_line}-\text{line_limit} \quad (15).$$

In step 702', the region where an added surface image is captured is reconfirmed. If the number of pixels required for determining the kind of the recording medium P is reached (YES in step 702'), the processing proceeds to step 804 to determine the kind of the recording medium P. If the number of pixels required for determining the kind of the recording medium P is not reached (NO in step 702'), the processing proceeds to step 805 to reconfirm the number of lacking lines. In the present exemplary embodiment, the following equation is used:

$$\text{last_line}=((((\text{err_data[i]}\times\text{line_end})+(\text{err_data[j]}\times\text{line_pixel_total}))-\text{area_limit})/\text{line_pixel_total}) \quad (16).$$

A pseudo-calculation for the number of lacking lines acquired by the equation (16) is added to the determination result obtained in step 806. In the present exemplary embodiment, the above addition is performed by the following equation:

$$\text{Peakj}=\text{Peakj}+(\text{Peakj}/(\text{area_limit}-\text{last_line})\times\text{last_line}) \quad (17).$$

By adding the equation (17) to the determination result, the calculation result can be compensated in a pseudo manner with respect to a lacking surface image on the recording medium P, so that the surface property of the recording medium P can be provisionally determined. As far as "Peaki" is concerned, even if the number of measurement lines is increased in "Peakj", "Peaki" is averaged by the above calculation process. Consequently, the value of "Peaki" as the calculation result in which a peak in the column direction is detected, is not changed, so that a special process is not performed in step 806. After the process is performed in step 806, in step 804, the kind of the recording medium P is determined.

As described above, if the number of pixels required for determining the kind of the recording medium P is lacking even if the region of the surface image is added when a large number of abnormal pixels is detected and removed from the region of the surface image used for determining the kind of the recording medium P, the number of images can be secured in a pseudo manner. Thus, accuracy can be improved in determining the kind of the recording medium P.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A recording medium determination apparatus comprising:

an irradiation unit configured to emit light to a recording medium;

an imaging unit configured to capture light emitted from the irradiation unit and via a recording medium as an image including a plurality of pixels; and a control unit configured to determine a type of the recording medium, using the image captured by the imaging unit, wherein the control unit determines a type of the recording medium, using data obtained by excluding data on a first pixel having an output value equal to or larger than a first threshold value and data on a second pixel located within a predetermined range from the first pixel and having an output value equal to or larger than a second threshold value which is smaller than the first threshold value from data on the plurality of pixels included in the image.

2. The recording medium determination apparatus according to claim 1, wherein the imaging unit successively captures light via the recording medium being conveyed as the image, and in a case where a difference in output values between a predetermined number of pixels which are sequentially adjacent in a conveyance direction of the recording medium is smaller than a predetermined value, the control unit determines a type of the recording medium using data obtained by excluding data on the predetermined number of pixels which are sequentially adjacent from the data on the plurality of pixels included in the image.

3. The recording medium determination apparatus according to claim 1, wherein, in a case where a number of the data obtained by excluding a part of the data is smaller than a number of data required for determining a type of the recording medium, the control unit controls the imaging unit to additionally capture an image.

4. The recording medium determination apparatus according to claim 3, wherein the control unit controls a size of the image additionally captured by the imaging unit depending on a difference between the number of the data obtained by excluding the part of the data and the number of the data required for determining a type of the recording medium.

5. The recording medium determination apparatus according to claim 3, wherein, in a case where the number of the data required for determining a type of the recording medium cannot be secured even if the imaging unit additionally captures the image, the control unit calculates data on a difference between a number of data combining the data obtained by excluding the part of the data and the data on the additionally captured image, and the number of the data required for determining a type of the recording medium.

6. The recording medium determination apparatus according to claim 1, wherein the output value is a brightness or a light quantity.

7. The recording medium determination apparatus according to claim 1, wherein the control unit determines a type of the recording medium using data obtained by excluding data on a third pixel having an output value equal to or smaller than a third threshold value which is smaller than the second threshold value from the data on the plurality of pixels included in the image.

8. The recording medium determination apparatus according to claim 1, wherein the pixel located within the predetermined range from the first pixel is a pixel adjacent to the first pixel.

9. The recording medium determination apparatus according to claim 1, wherein the irradiation unit emits light to the recording medium being conveyed, and the imaging unit captures light emitted from the irradiation unit and via the recording medium being conveyed as the image.

10. The recording medium determination apparatus according to claim 1, wherein the imaging unit captures light emitted from the irradiation unit and reflected by the recording medium as the image.

11. The recording medium determination apparatus according to claim 1, wherein a type of the recording medium indicates a surface state of the recording medium.

12. An image forming apparatus comprising:

an image forming unit configured to form an image on a recording medium;

an irradiation unit configured to emit light to the recording medium;

an imaging unit configured to capture light emitted from the irradiation unit and via the recording medium as the image including a plurality of pixels; and a control unit configured to determine a type of the recording medium, using the image captured by the imaging unit, wherein the control unit determines a type of the recording medium, using data obtained by excluding data on a first pixel having an output value equal to or larger than a first threshold value and data on a second pixel located within a predetermined range from the first pixel and having an output value equal to or larger than a second threshold value which is smaller than the first threshold value from data on the plurality of pixels included in the image.

13. The image forming apparatus according to claim 12, wherein the pixel located within the predetermined range from the first pixel is a pixel adjacent to the first pixel.

14. A recording medium determination apparatus comprising:

an irradiation unit configured to emit light to a recording medium;

an imaging unit configured to capture light emitted from the irradiation unit and via the recording medium as an image including a plurality of pixels; and a control unit configured to determine a type of the recording medium, using the image captured by the imaging unit, wherein the control unit determines a type of the recording medium, using data obtained by excluding data on a first pixel having an output value equal to or smaller than a first threshold value and data on a second pixel located within a predetermined range from the first pixel and having an output value equal to or smaller than a second threshold value which is larger than the first threshold value from data on the plurality of pixels included in the image.

15. The recording medium determination apparatus according to claim 14, wherein the output value is a brightness or a light quantity.

16. The recording medium determination apparatus according to claim 14, wherein the imaging unit successively captures light via the recording medium being conveyed as the image, and in a case where a difference in output values between a predetermined number of pixels which are sequentially adjacent in a conveyance direction of the recording medium is smaller than a predetermined value, the control unit determines a type of the recording medium using data obtained by excluding data on the predetermined number of pixels which are sequentially adjacent from the data on the plurality of pixels included in the image.

17. The recording medium determination apparatus according to claim 14, wherein, in a case where a number of the data obtained by excluding a part of the data is smaller than a number of data required for determining a type of the recording medium, the control unit controls the imaging unit to additionally capture an image.

18. The recording medium determination apparatus according to claim 17, wherein the control unit controls a size of the image additionally captured by the imaging unit depending on a difference between the number of the data obtained by excluding the part of the data and the number of the data required for determining a type of the recording medium.

19. The recording medium determination apparatus according to claim 17, wherein, in a case where the number of the data required for determining a type of the recording medium cannot be secured even if the imaging unit additionally captures the image, the control unit calculates data on a difference between a number of data combining the data obtained by excluding the part of the data and the data on the additionally captured image, and the number of the data required for determining a type of the recording medium.

20. The recording medium determination apparatus according to claim 14, wherein the control unit determines a type of the recording medium using data obtained by excluding data on a third pixel having an output value equal to or larger than a third threshold value which is larger than the second threshold value from the data on the plurality of pixels included in the image.

21. The recording medium determination apparatus according to claim 14, wherein the pixel located within the predetermined range from the first pixel is a pixel adjacent to the first pixel.

22. The recording medium determination apparatus according to claim 14, wherein the irradiation unit emits light to the recording medium being conveyed, and the imaging unit captures light emitted from the irradiation unit and via the recording medium being conveyed as the image.

23. The recording medium determination apparatus according to claim 14, wherein the imaging unit captures light emitted from the irradiation unit and reflected by the recording medium as the image.

24. The recording medium determination apparatus according to claim 14, wherein a type of the recording medium indicates a surface state of the recording medium.

25. An image forming apparatus comprising:

an image forming unit configured to form an image on a recording medium;

an irradiation unit configured to emit light to the recording medium;

an imaging unit configured to capture light emitted from the irradiation unit and via the recording medium as the image including a plurality of pixels; and a control unit configured to determine a type of the recording medium, using the image captured by the imaging unit, wherein the control unit determines a type of the recording medium, using data obtained by excluding data on a first pixel having an output value equal to or smaller than a first threshold value and data on a second pixel located within a predetermined range from the first pixel and having an output value equal to or smaller than a second threshold value which is larger than the first threshold value from data on the plurality of pixels included in the image.

26. The image forming apparatus according to claim 25, wherein the pixel located within the predetermined range from the first pixel is a pixel adjacent to the first pixel.

* * * * *